US007507297B2

(12) United States Patent
Irie et al.

(10) Patent No.: US 7,507,297 B2
(45) Date of Patent: Mar. 24, 2009

(54) CLEANING METHOD AND CLEANING APPARATUS

(75) Inventors: Yousuke Irie, Nara (JP); Kiyoyuki Morita, Yawata (JP); Masaaki Suzuki, Osaka (JP); Akihisa Adachi, Ikoma (JP); Masahiko Hashimoto, Shijonawate (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 10/514,811

(22) PCT Filed: May 12, 2003

(86) PCT No.: PCT/JP03/05870

§ 371 (c)(1),
(2), (4) Date: Nov. 18, 2004

(87) PCT Pub. No.: WO03/097258

PCT Pub. Date: Nov. 27, 2003

(65) Prior Publication Data

US 2005/0199263 A1 Sep. 15, 2005

(30) Foreign Application Priority Data

May 20, 2002 (JP) ..... 2002-144246
Jul. 23, 2002 (JP) ..... 2002-213403

(51) Int. Cl.

| | |
|---|---|
| ***B08B 7/04*** | (2006.01) |
| ***B08B 7/00*** | (2006.01) |
| ***B08B 5/00*** | (2006.01) |
| ***B08B 3/00*** | (2006.01) |
| ***B08B 3/02*** | (2006.01) |
| ***B08B 3/04*** | (2006.01) |

(52) U.S. Cl. ..... 134/18; 134/19; 134/26; 134/30; 134/31; 134/25.4; 134/34; 134/37; 134/902

(58) Field of Classification Search ..... 134/2, 134/19, 21, 26, 18, 902, 1, 40, 25.4, 36, 37, 134/10, 31, 105, 184, 57 R, 34, 35
See application file for complete search history.

(56) References Cited

U.S. PATENT DOCUMENTS

| | | | | |
|---|---|---|---|---|
| 5,013,366 | A * | 5/1991 | Jackson et al. | 134/1 |
| 5,494,526 | A | 2/1996 | Paranjpe | |
| 6,596,093 | B2 * | 7/2003 | DeYoung et al. | 134/36 |
| 6,612,317 | B2 * | 9/2003 | Costantini et al. | 134/58 R |

FOREIGN PATENT DOCUMENTS

| | | | |
|---|---|---|---|
| JP | 59-502137 | | 12/1984 |
| JP | 1-204427 | | 8/1989 |
| JP | 3-123604 | | 5/1991 |
| JP | 03-123604 | * | 5/1991 |

(Continued)

*Primary Examiner*—Alexander Markoff
(74) *Attorney, Agent, or Firm*—Wenderoth, Lind & Ponack, L.L.P.

(57) ABSTRACT

A cleaning effect is improved by cleaning a component that has a recess structure by using a cleaning medium of a liquefied gas or a supercritical fluid. By the cleaning method of removing adhering substances adhering to at least the surface of the recess structure of the component that has the recess structure, cleaning is carried out by using the supercritical gas or the liquefied gas so that the cleaning medium spreads over the surface of the recess structure.

13 Claims, 19 Drawing Sheets

FOREIGN PATENT DOCUMENTS

| | | |
|---|---|---|
| JP | 5-143981 | 6/1993 |
| JP | 6-272015 | 9/1994 |
| JP | 7-302776 | 11/1995 |
| JP | 8-57437 | 3/1996 |
| JP | 9-263994 | 10/1997 |
| JP | 10-24270 | 1/1998 |
| JP | 10-163152 | 6/1998 |
| JP | 10-192670 | 7/1998 |
| JP | 2832190 | 10/1998 |
| JP | 11-90362 | 4/1999 |
| JP | 11-92990 | 4/1999 |
| JP | 11-207276 | 8/1999 |
| JP | 11-216437 | 8/1999 |
| JP | 2000-225382 | 8/2000 |
| JP | 2000-280262 | 10/2000 |
| JP | 2000-308862 | 11/2000 |
| JP | 2000-344826 | 12/2000 |
| JP | 2001-203180 | 7/2001 |
| JP | 3234541 | 9/2001 |
| JP | 2001-319917 | 11/2001 |
| WO | 97/42667 | 11/1997 |
| WO | 97/42668 | 11/1997 |
| WO | 98/10475 | 3/1998 |
| WO | 01/87505 | 11/2001 |
| WO | 02/15251 | 2/2002 |

* cited by examiner

TEMPERATURE DEPENDENCE OF WATER PHYSICAL PROPERTIES (25MPa)

DENSITY OF OBJECT TO BE CLEANED<DENSITY OF FLUID

DENSITY OF OBJECT TO BE CLEANED>DENSITY OF FLUID

CLEANING METHOD AND CLEANING APPARATUS

BACKGROUND OF THE INVENTION

1. Technical Field of the Invention

The present invention relates to a cleaning method and a cleaning apparatus for objects to be cleaned such as components that has recess structures or more concretely components formed by machining, press processing, or the like and particularly precision machined components to be used for electronics components and so on.

2. Description of the Related Art

Conventionally, there have been three indispensable processes of "cleaning", "rinsing", and "drying" for the components formed by machining, press processing, or the like and particularly the precision machined components to be used for electronics components after the process machining, press processing, or the like. This is because a processing oil is used for the object to be processed during machining or press processing and the unnecessary processing oil that adheres to this object to be processed is required to be removed. Particularly, in the case of a precision component that needs an advanced cleaning effect, there is also demanded a cleaning agent of high cleaning capability, and extreme importance is attached to the drying process that is the final process.

On the background as described above, the lubricating oil, or the processing oil has been removed by using vapor cleaning with flon 113 or 1,1,1-trichloroethane in the final process of the precision cleaning field. However, the flon 113 and 1,1,1-trichloroethane have caused the destruction of the ozone layer in environmental terms, and the 1,1,1-trichloroethane has largely influenced the human central nervous system and caused unconsciousness and respiratory arrest at a high density. For the above reasons, the fluorine regulation has started in July 1989 in Japan, and the production of flon was totally abolished in 1995.

In accordance with the abolition of flon 113 and 1,1,1-trichloroethane, there are recently used liquid cleaning agents, which substitute for the ozone destruction substances and exemplified by nonaqueous systems of bromine based solvents (1-bromopropane and propyl promide), hydrocarbon based solvents (normal paraffin system, isoparaffin system, naphthenic system, and aromatic system), iodine based solvents (perfluoro-n-propyl iodide, perfluoro-n-butyl iodide, and perfluoro-n-hexyl iodide), chlorine based solvents (aliphatic group of trichloroethylene, tetrachloroethylene, methylene chloride, and trans-1,2-dichloroethylene, aromatic group of monochlorotoluene, benzotrifluoride, parachlorobenzotrifluoride (PCBTF), and 3,4-dichloro benzotrifluoride (3,4-DCBTF)), fluorine based solvents (HCFC system of HCFC-255ca, HCFC-141b, and HCFC-123, HFC system of HFC-4310mee, HFC-356mcf, and HFC-338Pcc, HFE system of HFE-7100 and HFE-7200, and cyclic HFC system of OFCPA), siloxane based solvents (volatile methylsiloxane system (VMS), dodecamethylcyclohexasiloxane, hexamethyldisiloxane, decamethyltetrasiloxane), ketone based solvents (methyl ethyl ketone (MEX)), and alcohol based solvents (ethanol, isopropanol (IPA), or pentafluoropropanol (5FP)).

As quasi-water systems, there are used hydrocarbon systems (normal paraffin system, isoparaffin system, naphthenic system, or aromatic group), glycol ethers (ethylene based glycol ether or isoprene based glycol ether), N-methyl-2-pyrrolidone (NMP), terbenzene (d-limonene), or siloxane systems (volatile methylsiloxane system: VMS, dodecamethylcyclohexane, hexamethyldisiloxane, or decamethyltetrasiloxane).

As water systems, there are enumerated additive-free water (deoxygenated water, deionized water, or ultrapure water), cleaning property-improved water with additive (alkaline system, acid system, ionic surface active agent, nonionic surface active agent, higher alcohol based surface active agent, or ozone-added ultrapure water), and so on.

As described above, numbers of liquid cleaning agents for substituting flon are produced, and cleaning methods using them are used for precision components.

As disclosed in Japanese unexamined patent publication No. H09-263994 of a battery casing, there is used cleaning for burning out the lubricating oil, or the processing oil by carrying out annealing at a very high temperature of 700 to 900° C. instead of the organic solvent. However, in the case of an aluminum sheet for film lamination used for aluminum electrolytic capacitors, dirt of rolling oil, metal powders, and so on left on the rolled sheet surface is burnt onto the surface during annealing, and this causes troubles of defective appearance, defective adhesion, and so on. Therefore, according to Japanese unexamined patent publication No. H06-272015 of annealing in a softening process, the annealing process is carried out after cleaning the surface of the aluminum sheet with mineral acid or organic acid or the mixed acid of them.

Moreover, according to the international publication Nos. WO97/42668, WO97/42667 and WO98/10475, as a battery casing, there is recently used a surface treated steel sheet obtained by degreasing a steel sheet by using an organic solvent or an alkaline based degreasing agent, subjecting the sheet to cleaning with acid, plating, and postheating treatment, heating the sheet to the melting point of a petroleum wax based lubricant to be coated and using the surface treated steel sheet on the surface of which the molten lubricant has been coated for deep drawing processing, DI (Drawn & Ironed) processing or DS (Dry Sanding) processing, and DTR (Drawing & Thin Redrawing) processing. The greater part of this lubricating oil can be simplify vaporized and removed if heating is carried out at a temperature of 200 to 350° C. after the processing and molding, and therefore, the cleaning after the processing can be simplified.

Furthermore, in the case of the casing of the HDD (Hard Disk Drive), electrolytic capacitors, precision electronic components, and so on described in Japanese Patent No. 3234541, an organic resin film, which contains a lubricant on one surface or both surfaces of an aluminum alloy material, is formed to improve the molding processability, a volatile lubricant is coated on its surface and the lubricant is vaporized and removed by heating after the processing.

As another cleaning method, as disclosed in Japanese unexamined patent publication No. 2000-225382, it is proposed to change the state of the metal mold surface with coexisting organic or inorganic reducing agent that operates as a cleaning element and to clean and remove dirt without damage caused by an object put in contact when cleaning metal components and the metal mold with water in a supercritical or subcritical state. Moreover, Japanese publicized Japanese translation of PCT international application No. 59-502137 proposes a cleaning method for removing organic matters by using a supercritical gas. Moreover, Japanese patent No. 2832190 discloses a method for improving the cleaning effect by rapidly changing the state of the fluid in a supercritical or subcritical state.

As described above, the lubricating oil for improving the molding processability is indispensable for molding processing, and it is no exaggeration to say that the development of a lubricating oil is worthy of the development of more advanced molding processing. However, the lubricating oil used for this molding processing causes defective products due to the deterioration of product performances, contamination, and so on unless the oil is completely removed when the processed precision components are used as products. Therefore, it is also indispensable to develop a cleaning method for completely removing this lubricating oil similarly to coating of the lubricating oil during the molding processing.

However, the substitute flons (chlorofluorocarbons) are often used as solvents that exert no influence on the destruction of the ozone layer considering the environmental factors with regard to the cleaning method using a solvent and particularly to degreasing, whereas the influences on the environment have been discovered a little. For example, 2-bromopropane is an existing material that has been used as an intermediate of pharmaceuticals, agricultural chemicals, and photosensitizers, an alkylating agent, and so on. Moreover, the time and cost necessary for cleaning becomes a serious problem. A cleaning level after processing is determined depending on what kind of product the molded component is used for. Therefore, it is desirable to use a solvent of high detergency, whereas the influences of the solvent of high detergency exerting on the environment are unknown as described above. Therefore, since the solvent that exerts a little influence also has a low detergency, the time and processes (cleaning frequency) must also be increased.

For example, precision cleaning is necessary for the components that are plated after processing like battery casings and aluminum electrolytic capacitors, and a long time is necessary for carrying out the cleaning process to carry out degreasing, impurity removal, and activation. Moreover, prevention of degassing during use is important for the casings used for HDD's and so on, and importance is attached to the degreasing process. Moreover, in a case of solvent cleaning, handling is very complicated with regard to the management factors of solvent management (Fire Protection Law), human treatment (Occupational Health and Safety Law), waste fluid recovery and so on, and much labor have been required for them, consequently reducing the productive efficiency.

Accordingly, there has been the growing trend of using a method for evaporating the volatile lubricating oil through annealing after the processing by a combination of an organic resin coating and a volatile lubricating oil as a method for simplifying the cleaning method of using a solvent as far as possible or a method dispensable with cleaning with solvent. However, this method is, of course, not able to completely evaporate the lubricating oil, and oil contents, impurities and so on disadvantageously slightly remain by all means on the processed surface on the microscopic level. Moreover, particularly in the case of deep drawing components that have undergone press molding, components that have complicated structures of recess portions and so on, it is often the case where the lubricating oil is incompletely evaporated due to the structural factors and the case where the lubricating oil for pressing is rubbed into the grain boundaries and so on of stainless steel or the like and impurities remain even when the components are annealed for evaporating the lubricating oil. When the annealing has been carried out in a state in which the residues of oil contents, impurities and so on exist even a little, the oil contents have been carbonized or the impurities have become burnt, consequently causing reductions in the performance of the application products due to defects ascribed to stains and nonuniformity and degassing. Furthermore, the surface treated steel sheet, which is used for the purpose of simplifying the cleaning after the processing or preventing the reduction in the performance of the products even when precision cleaning is not carried out, is subjected to degreasing by means, of an organic solvent or an alkaline based degreasing agent, cleaning with acid, plating, and postheating treatment similarly to the conventional case in the manufacturing processes of the surface treated steel sheet. Therefore, the difference resides only between the cleaning carried out before the processing and the cleaning carried out after the processing, and the influences on the environment and the human beings are scarcely improved.

As another cleaning method considering the environmental factors, there is proposed a cleaning method for carrying out cleaning by means of carbon dioxide or water in a supercritical or subcritical state. This method is merely applied to precision metal molds and peripheral components of the metal mold of a plastic mold lens prism and so on that attach importance to making an organic or inorganic reducing agent that operates as a cleaning element coexist with carbon dioxide or water in the supercritical or subcritical state and carrying out cleaning causing neither the change in the surface state of the metal mold nor damages due to objects put in contact, and mainly intended to remove organic matters.

However, with regard to the components processed by press molding, in particular, electronic components, it has often been the case where the impurities generated during the molding processing are not only the organic matters represented by the lubricating oil but also single bodies of the inorganic matters of swarf, powders, and so on and mixtures of organic matters and inorganic matters, and it has been difficult to obtain an effect of removing the organic matters in an environment in which the organic matters and the inorganic matters coexist even when there is the effect of removing the organic matter.

Moreover, the cleaning system has been very expensive, and much time has been necessary for the cleaning. Therefore, the objects to be cleaned have been mainly the components of metal molds and so on, which have been very expensive and repetitively used.

Accordingly, the object of the present invention is to solve the aforementioned issues and provide a cleaning method and cleaning apparatus of an object to be cleaned such as a component that has a recess structure, capable of improving the cleaning effect by cleaning the object to be cleaned such as the component that has the recess structure by means of a cleaning medium of a liquefied gas or a supercritical fluid.

SUMMARY OF THE INVENTION

In order to achieve the aforementioned object, the present invention is constituted as follows.

According to a first aspect of the present invention, there is provided a cleaning method for removing adhering substances that adhere to at least a surface of a recess structure of a component that has the recess structure, the method comprising:

accommodating the component to which the adhering substances adhere, in a cleaning bath; and introducing a cleaning medium into the cleaning bath to locate the component in an atmosphere of the cleaning medium and changing a temperature and a pressure of the cleaning medium to change a state of the cleaning medium alternately between a liquid state and a gaseous state, so that the cleaning medium spreads over the surface of the recess structure for cleaning.

According to a sixth aspect of the present invention, there is provided a cleaning method for removing adhering substances that adhere to at least a surface of a recess structure of a component that has the recess structure, the method comprising:

placing the component to which the adhering substances adhere in a cleaning bath; and introducing a first cleaning medium into the cleaning bath to locate the component in an atmosphere of the first cleaning medium, changing a temperature and a pressure of the first cleaning medium to change a state of the first cleaning medium into a supercritical state so that the first cleaning medium spreads over the surface of the recess structure for cleaning, and thereafter further carrying out cleaning of the component with a liquid that serves as a second cleaning medium.

According to a ninth aspect of the present invention, there is provided a cleaning apparatus comprising:

a cleaning bath;

a cleaning medium supply section for supplying a cleaning medium to the cleaning bath;

a heating unit for causing change in a temperature of the cleaning medium;

a pressurizing unit for causing change in a pressure of the cleaning medium; and a control means for controlling the cleaning medium supply section, the heating unit, and the pressurizing unit, wherein a surface of a recess structure of a component is cleaned in the cleaning bath by changing a state of the cleaning medium alternately between a liquid state and a gaseous state and thereafter changing the state of the cleaning medium into a supercritical state or a subcritical state by controlling at least one of the heating unit and the pressurizing unit.

According to a tenth aspect of the present invention, there is provided a cleaning apparatus comprising:

a cleaning bath that has an inlet port for introducing a cleaning medium and an outlet port for discharging the cleaning medium, for accommodating therein an object to be cleaned;

a cleaning medium supply section for supplying the cleaning medium into the cleaning bath via the inlet port;

a heating unit for causing change in a temperature of the cleaning medium;

a pressurizing unit for causing change in a pressure of the cleaning medium;

a control means for controlling the cleaning medium supply section, the heating unit, and the pressurizing unit; and a collection section for recovering the cleaning medium discharged from the outlet port and collecting a removed substance after cleaning, wherein cleaning is carried out by controlling at least one of the heating unit and the pressurizing unit using a supercritical gas or a liquefied gas for the object to be cleaned that has a recess structure and is placed in the cleaning bath so that the cleaning medium spreads over a surface of the recess structure for cleaning, the inlet port is positioned on a lower side of the outlet port, and the outlet port is positioned on an upper side of the object to be cleaned.

According to a 20th aspect of the present invention, there is provided a cleaning method for removing impurities that adhere to a surface of an object to be cleaned by bringing a pressurized fluid in contact with an object to be cleaned, the cleaning method with the pressurize fluid comprising:

changing at least one condition of a pressure and a temperature of the fluid with the object to be cleaned having a density not higher than a liquid density of the fluid;

repetitively increasing and decreasing the density of the fluid with respect to the density of the object to be cleaned by the changing; and bringing the object to be cleaned in contact with the fluid by the repetitively increasing and decreasing.

According to a 21st aspect of the present invention, there is provided a cleaning method for removing impurities that adhere to a surface of an object to be cleaned by bringing a pressurized fluid in contact with an object to be cleaned, the cleaning method with the pressurize fluid comprising:

changing at least one condition of a pressure and a temperature of the fluid with the object to be cleaned having a density not higher than a liquid density of the fluid;

giving a change with an external force to the fluid in a state in which the density of the object to be cleaned and the density of the fluid made approximately equal to each other by the changing; and bringing the object to be cleaned in contact with the fluid by the giving of the change.

According to a 23rd aspect of the present invention, there is provided a cleaning method for removing impurities that adhere to a surface of an object to be cleaned by bringing a pressurized fluid in contact with the object to be cleaned, the cleaning method with the pressurized fluid comprising:

in cleaning the object to be cleaned immersed in a pressurized first fluid by bringing the object to be cleaned in contact with a pressurized second fluid of a density different from that of the first fluid, bringing the second fluid in contact with the object to be cleaned without changing a state of phase of the first fluid.

That is, in order to solve the aforementioned issues, the present invention provides a cleaning method for removing at least adhering substances that adhere to the surface of the recess structure of the component that has the recess structure, the cleaning method being carried out by means of a supercritical gas or a liquefied gas so that the cleaning medium evenly can spread over the surface of the recess structure.

With this arrangement, the cleaning medium using the supercritical gas or the liquefied gas evenly spreads over the surface of the recess structure, and thus the adhering substances that adhere to the recess portion can be cleaned easily and rapidly.

BRIEF DESCRIPTION OF THE DRAWINGS

These and other aspects and features of the present invention will become clear from the following description taken in conjunction with the preferred embodiments thereof with reference to the accompanying drawings, in which:

FIG. 29 is a phase diagram of a fluid of carbon dioxide, water, or the like;

DETAILED DESCRIPTION OF THE INVENTION

Figure 1:
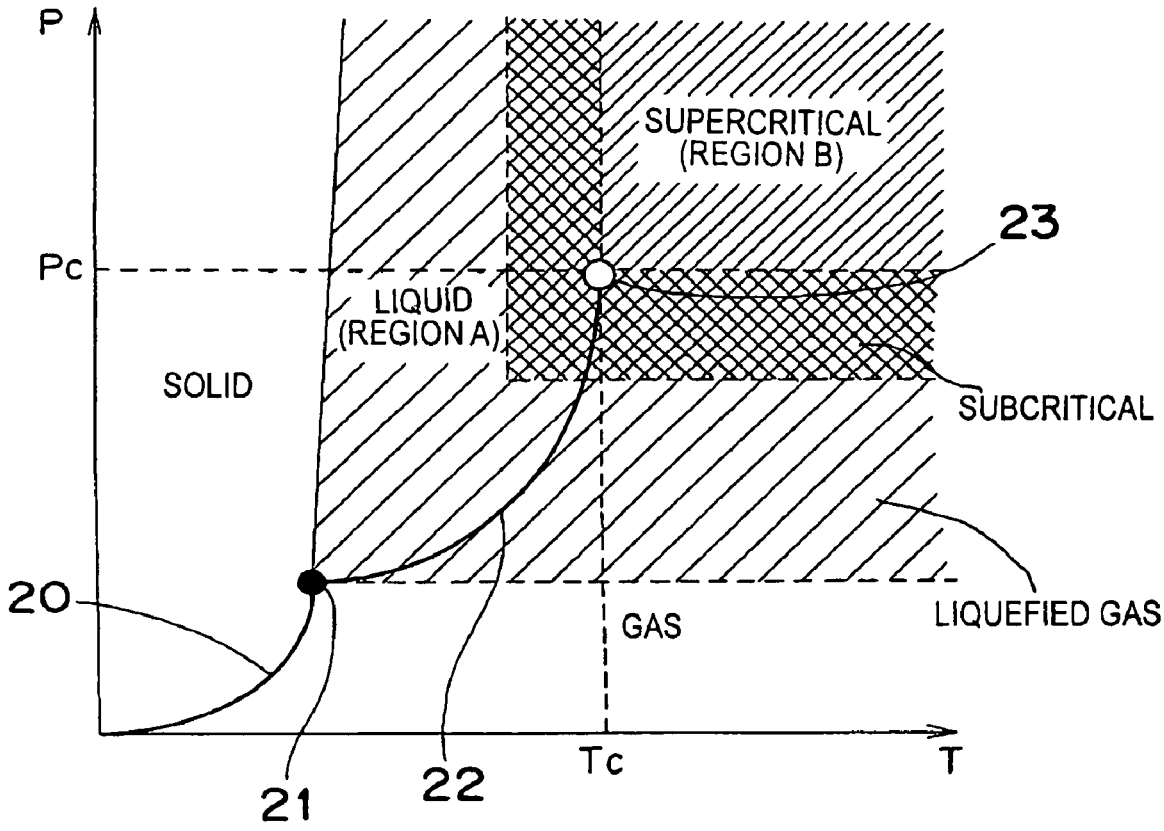
FIG. 1 is a phase diagram of a cleaning medium according to a first embodiment of the present invention.
Figure 2A:
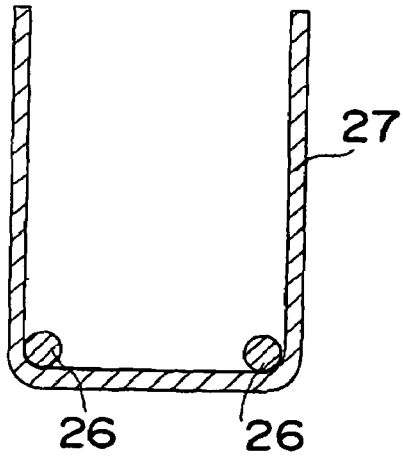
FIGS. 2A, 2B, 2C and 2D are sectional views and perspective views showing examples of the component that has a recess structure of the first embodiment of the present invention.
Figure 2B:
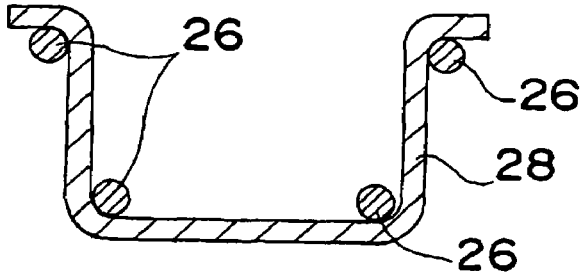
Figure 2C:
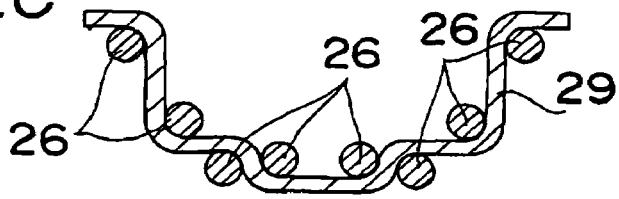
Figure 2D:
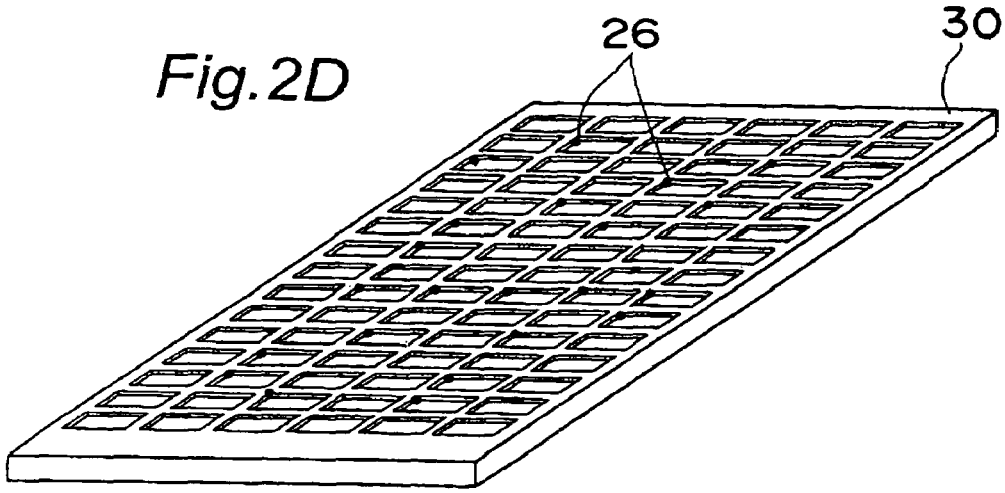

Before the,description of the present invention proceeds, it is to be noted that like parts are designated by like reference numerals throughout the accompanying drawings.

Before explaining the embodiments of the present invention with reference to the drawings, the outline of the present invention will be described below.

The first invention of the present invention is a cleaning method for removing adhering substances that adhere to at least a surface of a recess structure of a component that has the recess structure, the cleaning being carried out by using a supercritical gas or a liquefied gas so that the cleaning medium evenly can spread over the surface of the recess structure.

The second invention of the present invention is a cleaning method for carrying out cleaning so that the cleaning medium evenly can spread over the recess structure surface of the component according to the first invention of the present invention.

The third invention of the present invention is a cleaning method for removing adhering substances that adhere to at least a surface of a recess structure of a component that has the recess structure, the method carrying out cleaning by accommodating the component to which the adhering substances adhere in a cleaning bath, and introducing a cleaning medium into the cleaning bath to locate the component in the atmosphere of the cleaning medium, and changing the temperature and the pressure of the cleaning medium to change the state of the cleaning medium alternately between the liquid state and the gaseous state, so that the cleaning medium evenly spreads over the surface of the recess structure.

With this arrangement, the cleaning efficiency is improved by controlling the physical properties of the density, viscosity, and so on in the liquid state and utilizing the physical energy that contributes to the change of state among the liquid state, the gaseous state, and the supercritical state.

The fourth invention of the present invention is a cleaning method for cleaning the surface of the recess structure by alternately changing the state of the cleaning medium between the liquid state and the gaseous state and thereafter changing the state of the cleaning medium into the supercritical state according to the third invention of the present invention.

The fifth invention of the present invention is a cleaning method for cleaning the surface of the recess structure by alternately changing the state of the cleaning medium between the liquid state and the gaseous state and thereafter changing the state of the cleaning medium into the sub-supercritical state according to the third invention of the present invention.

The sixth invention of the present invention is a cleaning method for changing the state of the cleaning medium by alternately repeating the gaseous state and the liquid state by changing the pressure of the cleaning medium from the liquid state with the temperature kept constant according to the third or fourth invention of the present invention.

The seventh invention of the present invention is a cleaning method for changing the state of the cleaning medium by alternately repeating the gaseous state and the liquid state by changing the pressure of the cleaning medium with the temperature kept constant according to the third or fourth invention of the present invention.

The eighth invention of the present invention is a cleaning method for removing adhering substances that adhere to at least a surface of a recess structure of a component that has the recess structure, the method carrying out cleaning by accommodating the component to which the adhering substances adhere in a cleaning bath; introducing a cleaning medium into the cleaning bath to locate the component in the atmosphere of the cleaning medium; and changing the temperature and the pressure of the cleaning medium to change the state of the cleaning medium into the supercritical state, so that the cleaning medium evenly spreads over the surface of the recess structure.

The ninth invention of the present invention is a cleaning method for removing adhering substances that adhere to at least a surface of a recess structure of a component that has the recess structure, the method carrying out cleaning by accommodating the component to which the adhering substances adhere in a cleaning bath; and introducing a cleaning medium into the cleaning bath to locate the component in the atmosphere of the cleaning medium; changing the temperature and the pressure of the cleaning medium to change the state of the cleaning medium into the supercritical state so that the cleaning medium evenly spreads over the surface of the recess structure and thereafter further carrying out cleaning with liquid.

The tenth invention of the present invention is a cleaning method, by which the cleaning medium is carbon dioxide and water according to any one of the first through ninth inventions of the present invention.

The eleventh invention of the present invention is a cleaning method for removing adhering substances that adhere to at least a surface of a recess structure of a component that has the recess structure, the method carrying out the cleaning of the surface of the recess structure by accommodating the component to which the adhering substances adhere in a cleaning bath; introducing carbon dioxide that serves as the cleaning medium into the cleaning bath to locate the component in the atmosphere of the cleaning medium; and changing the temperature and the pressure of the cleaning medium to change the state of the cleaning medium into the supercritical state so that the cleaning medium evenly spreads over the surface of the recess structure, thereafter further newly introducing water as a cleaning medium to change the state of water of the cleaning medium into the supercritical state.

The twelfth invention of the present invention is a cleaning apparatus provided with a cleaning bath, a cleaning medium supply section for applying a cleaning medium to the cleaning bath, a heating unit for causing a change in the temperature of the cleaning medium, a pressurizing unit for causing a change in the pressure of the cleaning medium, and a control means for controlling the cleaning medium supply section, the heating unit and the pressurizing unit, the apparatus carrying out cleaning by controlling at least one of the heating unit, and the pressurizing unit using a supercritical gas or a liquefied gas for the object to be cleaned that has the recess structure and is placed in the cleaning bath so that the cleaning medium evenly spreads over the surface of the recess structure.

The thirteenth invention of the present invention is a cleaning apparatus for cleaning the surface of the recess structure by alternately changing the state of the cleaning medium between the liquid state and the gaseous state by controlling at least one of the heating unit and the pressurizing unit and thereafter changing the state of the cleaning medium into a supercritical state or a subcritical state according to the twelfth invention of the present invention.

The fourteenth invention of the present invention is a cleaning apparatus provided with a cleaning bath that has an inlet port for introducing a cleaning medium and an outlet port for discharging the cleaning medium and accommodates therein an object to be cleaned; a cleaning medium supply section for supplying the cleaning medium into the cleaning bath via the inlet port; a heating unit for causing a change in a temperature of the cleaning medium; a pressurizing unit for causing a change in a pressure of the cleaning medium; a control means for controlling the cleaning medium supply section, the heating unit, and the pressurizing unit; and an extraction and collection vessel that serves as a collection section for recovering the cleaning medium discharged from the outlet port and collecting a removed substance after cleaning, the apparatus carrying out cleaning by controlling at least one of the heating unit and the pressurizing unit using a supercritical gas or a liquefied gas for the object to be cleaned that has a recess structure and is accommodated in the cleaning bath so that the cleaning medium evenly spreads over a surface of the recess structure, the inlet port being positioned on the lower side of the outlet port, and the outlet port being positioned on the upper side of the object to be cleaned.

The fifteenth invention of the present invention is a cleaning method characterized in that the component that has the recess structure is a structure formed by press molding or cutting method according to any one of the first through eleventh inventions of the present invention.

The sixteenth invention of the present invention is a cleaning method characterized in that the component that has the recess structure is a structure formed by the press molding method or the cutting method and the structure is constructed mainly of a metallic material according to any one of the first through eleventh inventions of the present invention.

The seventeenth invention of the present invention is a cleaning method characterized in that the metallic material, which forms the component that has the recess structure, has a principal ingredient of Fe, Al, Cu, or Ti according to the sixteenth invention of the present invention.

The eighteenth invention of the present invention is a cleaning method characterized in that the component that has the recess structure is a structure formed by the press molding method or the cutting method and the structure is constructed mainly of an organic material according to any one of the first through eleventh inventions of the present invention.

The nineteenth invention of the present invention is a cleaning method characterized in that the organic material, which forms the component that has the recess structure, has a principal ingredient of polyimide or epoxy resin according to the eighteenth invention of the present invention.

The twentieth invention of the present invention is a cleaning method characterized in that the component that has the recess structure is a structure formed by the press molding method or the cutting method and the structure is constructed mainly of a ceramic material according to any one of the first through eleventh inventions of the present invention.

The twenty-first invention of the present invention is a cleaning method characterized in that the ceramic material, which forms the component that has the recess structure, has a principal ingredient of $SiO_2$, PZT, Ag, or C according to the twentieth invention of the present invention.

The twenty-second invention of the present invention is a cleaning method characterized in that the component that has the recess structure is constructed mainly of a complex of a metal and an organic material; a complex of an organic material and a ceramic material; or a complex of a metal, an organic material, and a ceramic material according to any one of the first through eleventh inventions of the present invention.

The twenty-third invention of the present invention is a cleaning method characterized in that the component that has the recess structure is a matching layer of an ultrasonic sensor or a casing for an electronic component, an ultrasonic sensor, a cell, a HDD (hard disk drive), and an electrolytic capacitor according to any one of the first through eleventh inventions of the present invention.

In this case, a liquefied gas in the supercritical state or the liquid state (including the subcritical state) is used as one example of the cleaning medium. With regard to the kind of the liquefied gas, there is mainly used a single material of carbon dioxide ($CO_2$) or water ($H_2O$), or a mixture of carbon dioxide and water. Selection is made as to which cleaning medium is used or as to which cleaning mediums are combined, in accordance with the principal material that constitutes the component and the constituents of the contaminant.

For example, when the principal ingredient of the cleaning component is a metal, and the contaminants are the organic system of oils and fats and the oxide of the inorganic system, dirt of the organic system is first cleaned by means of carbon dioxide, and thereafter water is introduced to remove the oxides of the inorganic system by etching.

Moreover, the present invention improves the cleaning efficiency by controlling the physical properties of density, viscosity, and so on in the liquid state and utilizing the physical energy that contributes to the change of state among the liquid state, the gaseous state, and the supercritical state. Particularly, it is easy to handle carbon dioxide in the liquid state since the control of the physical properties of density, viscosity and so on of the liquid as well as the control of the gaseous state, the liquid state, and the supercritical state of carbon dioxide are also easy by changing the temperature or the pressure in the vessel, and the control temperature and the pressure difference are comparatively close to the normal temperature and the atmospheric pressure.

Moreover, there is a little adverse effect in environmental and human physical terms. By appropriately combining the physical properties and the change of state according to the object desired to be cleaned, it is possible to remove the contaminants (processing oil, swarf, and so on) with a physical energy generated in accordance with the physical properties and the change of state given to the contaminants and improve the cleaning efficiency by reducing the adhesive power of the contaminants to the object to be cleaned. For example, carbon dioxide in the liquid state is first introduced into a high pressure vessel, and the liquid state and the gaseous state are repeated by changing the temperature or the pressure. By concurrently changing the physical properties of carbon dioxide in accordance with the change of state in this process, a physical energy acts on the contaminants to reduce the adhesive strength of the contaminants. Subsequently, with a shift into the supercritical state, the organic elements of oils, fats, and so on are melted and resolved. It is known that the oils and fats of organic matters and the like can be melted and resolved by carbon dioxide in the supercritical state, and the contaminants of organic matters, inorganic matters, mixtures of organic matters and inorganic matters, and so on can be efficiently cleaned by a combination with the change of state into the gas state and the liquid state.

As one example of the object to be cleaned of the present invention, there is a component processed by press molding or a component processed by cutting, and the component is characterized by having a recess structure. Particularly, it is most difficult to clean the component that has a recess structure during cleaning since it is highly possible that the contaminants (processing oil, swarf, and so on) are rubbed into the recess structure portions in structural terms or with a pressure or the like applied during the processing and the swarf and the like in accordance with plastic deformation remain. However, by appropriately using the gaseous state, the liquid state, and the supercritical state of the liquefied gas, the cleaning efficiency of, in particular, the components that have the recess structures can be improved, and it is characterized that there is no need for a drying process since carbon dioxide enters the gaseous state at normal temperature. The components, which are the objects to be cleaned, are the components produced mainly by press molding and cutting, and the principal ingredients of the components are characterized by being constructed of metallic materials, organic materials, ceramic materials, or the complex of them. The principal ingredient of the metallic material includes any one of Fe, Al, Cu, and Ti. It is characterized in that the principal ingredient of the organic material is polyimide, epoxy resin, or thermoplastic resin, while the principal ingredient of the ceramic material is $SiO_2$, Ag, PZT, or C. The cleaning medium is selected from carbon dioxide, water, and so on according to the object to be cleaned.

The components to which the cleaning of the present invention is applied are, in particular, electronic components such as the matching layers and casings of ultrasonic sensors, casings and electrodes for cells, casings (housings) for HDD's, and casings for electrolytic capacitors, which concurrently satisfy the conditions that they have recess structures, need precision cleaning in terms of the cleaning level, possess high additional values and a small volume per unit.

The cleaning method and apparatus of the first embodiment of the present invention will be described below with reference to FIGS. 1 through 4B.

Reference is first made to a supercritical fluid and a liquefied gas used by the cleaning method.

FIG. 1 shows a phase diagram of a cleaning medium, of which the temperature T is plotted on the abscissa axis and the pressure P is plotted on the ordinate axis. A triple point (illustrated by a black dot 21) in FIG. 1 represents a state in which the three phases of gas, liquid, and solid coexist. The solid and its vapor keep equilibrium at a temperature lower than the temperature at the triple point, and the pressure of the vapor at the time is given by a sublimation curve (20 in FIG. 1). The solid sublimes to become gas at a pressure lower than this curve, and the gas is solidified to become a solid at a pressure higher than the curve. The liquid and its vapor are equilibrated at a temperature higher than the triple point, and the pressure at this time is expressed as a saturation vapor pressure by a vapor curve (22 in FIG. 1). The liquid is totally evaporated at a pressure lower than this curve, and the vapor is totally liquefied at a pressure higher than this curve (assumed to be a region A). The liquid becomes vapor and the vapor becomes liquid across this curve even if the temperature is changed with the pressure kept constant. The end point of this vapor curve is called the critical point (white dot 23 in FIG. 1) where a state in which distinction between liquid and gas is impossible exists, and the boundary between gas and liquid also disappears. In a state of a temperature higher than this critical point, a shift between liquid and gas is possible without causing a gas-liquid coexistence state. In this region, no condensation occurs no matter how the density is increased. This state (assumed to be a region B) not lower than the critical temperature (Tc) and not lower than the critical pressure (Pc) indicates a supercritical fluid.

Moreover, the liquefied gas indicates a state of a region in which the temperature range as shown in FIG. 1 is not lower than the temperature at the triple point and not higher than the critical temperature, and the pressure is not lower than the pressure at the triple point and higher than the vapor curve.

Then, there is interposed a subcritical state in which the temperature and the pressure are lower than those of the critical point as shown in FIG. 1 through the process from the state of the liquefied gas to the supercritical fluid. In this case, the subcritical state indicates a state within a range up to 0.6 times the critical temperature (Tc) and the critical pressure (Pc), and accordingly, there are the definitions of the state within the ranges of the subcritical temperature and the subcritical pressure as follows:

critical temperature (Tc)>subcritical temperature≧0.6× critical temperature (Tc); and critical pressure (Pc)>subcritical pressure≧0.6×critical pressure (Pc).

As described above, the cleaning medium changes in state from the liquefied gas via the subcritical state to the supercritical state.

The supercritical fluid or the liquefied gas used here is carbon dioxide ($CO_2$) or water ($H_2O$).

Carbon dioxide has a critical temperature (Tc)=31.1° C. and a critical pressure (Pc)=7.38 MPa, while water has a critical temperature (Tc)=374.1° C. and a critical pressure (Pc)=22.04 MPa.

Figure 3:
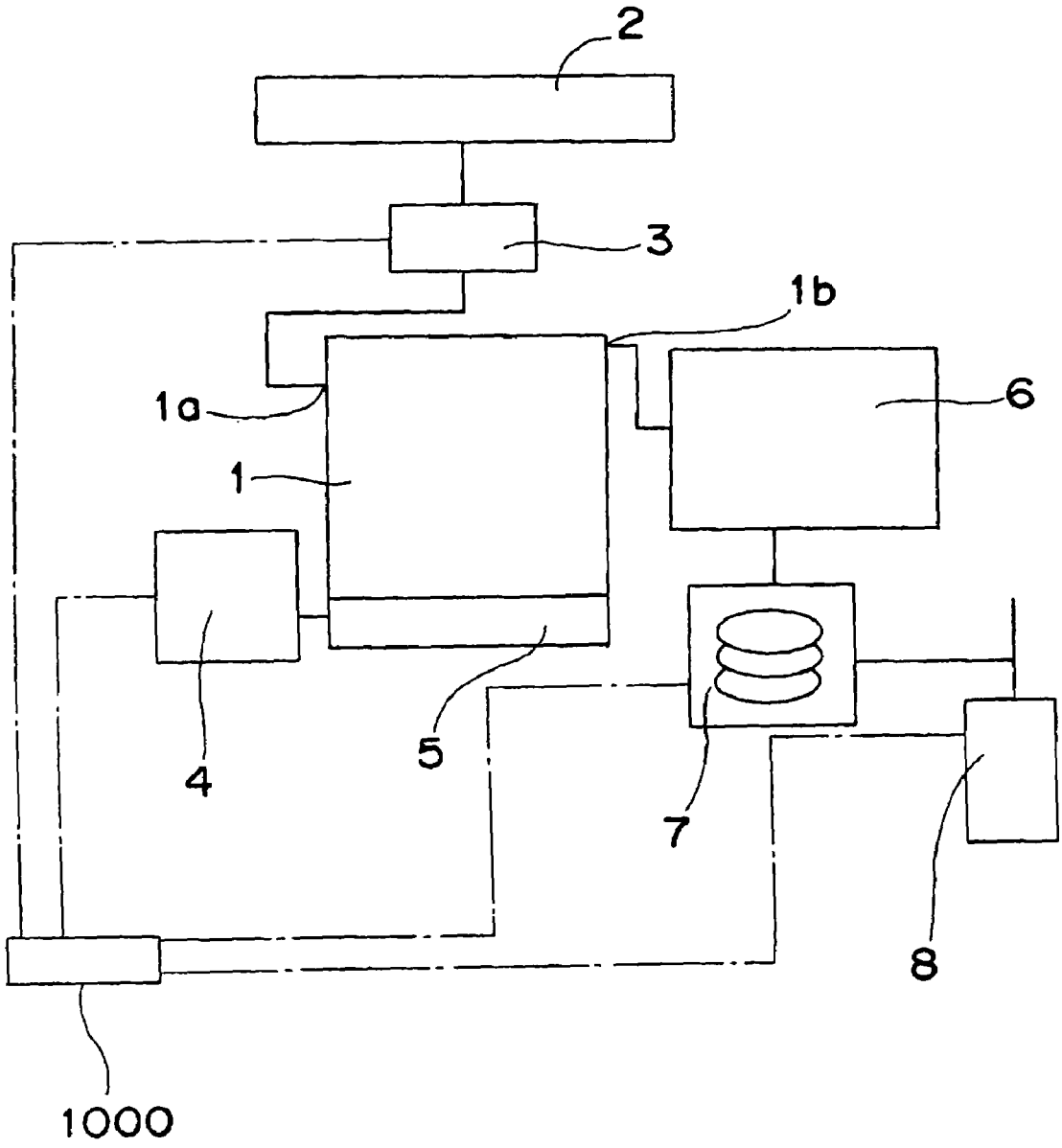
FIG. 3 is an explanatory view showing the cleaning system of the first embodiment of the present invention.

Reference is next made to the outline of the cleaning system of the first embodiment of the present invention with reference to FIG. 3. The cleaning apparatus of the first embodiment of the present invention is constructed of at least a high pressure vessel 1 of one example of the cleaning bath, a liquefaction supply tank (or high-pressure gas cylinder) 2 that has a cleaning medium, a liquid pump (corresponding to one example of the cleaning medium supply section) 3 for supplying a liquefied gas that becomes the cleaning medium from the liquefaction supply tank 2 to the high pressure vessel 1, a heater 5 for heating the inside of the high pressure vessel 1, a heater controller 4 for executing temperature control of the liquefied gas in the pressure vessel 1 by controlling the heater 5, a waste fluid collection tank 6 for collecting the waste fluid after cleaning inside the high pressure vessel 1, a vaporizer 7 for vaporizing the liquefied gas collected into the waste fluid collection tank 6, and an extraction and collection vessel 8 for collecting the removed substances after cleaning and serves as one example of the collection section. In the high pressure vessel 1, the pressure is changed by the supply of the liquefied gas by the fluid pump 3, and the temperature of the liquefied gas is controlled by the heater 5 under the control of the heater controller 4. Then, a supercritical fluid (a supercritical gas in the present embodiment), a subcritical fluid (a subcritical gas in the first embodiment), or a liquefied gas of the cleaning medium is generated by controlling the temperature and the pressure, and then the object to be cleaned is cleaned by the cleaning medium. Moreover, in FIG. 3, reference numeral 1000 denotes a control unit for controlling the cleaning operation of the cleaning apparatus, and the unit is connected to the liquid pump 3, the heater controller 4, the vaporizer 7, and the extraction and collection vessel 8 so as to control their operations.

Although the liquefied gas is used as the cleaning medium in this case, it is acceptable to supply the subcritical fluid or the supercritical fluid directly into the high pressure vessel 1, and the vaporizer 7 may vaporize the subcritical fluid or the supercritical fluid.

Reference is next made to the object to be cleaned. As shown in FIGS. 2A, 2B, 2C and 2D, components (27, 28, 29, 30) that have recess portions and are formed by press molding or the components (27, 28, 29, 30) formed by cutting easily makes the lubricating oil that is the processing oil and impurities (swarf and so on) of adhering substances 26 adhere particularly to the recess portions. Moreover, since the recess portions have complicated structures and receive pressures during processing, the adhesion of the lubricating oil that is the processing oil and impurities (swarf and so on) is high, and the cleaning agent or the like is hard to infiltrate in comparison with the other flat structure portions. Therefore, nonuniform cleaning and adhering substances of cleaning are easily generated.

Figure 10A:
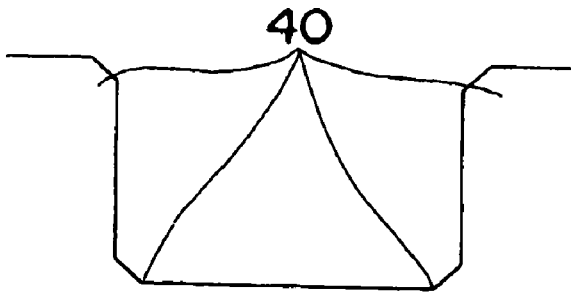
FIG. 10A is an explanatory view showing portions where dirt tends to remain macroscopically as indicated by arrows.
Figure 10B:
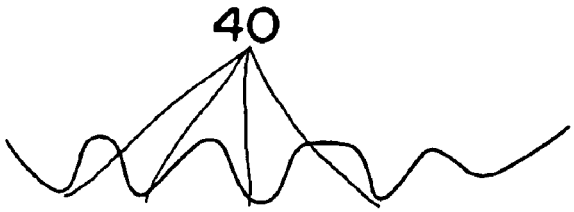
FIG. 10B is an explanatory view showing portions where dirt tends to remain microscopically as indicated by arrows.
Figure 11:
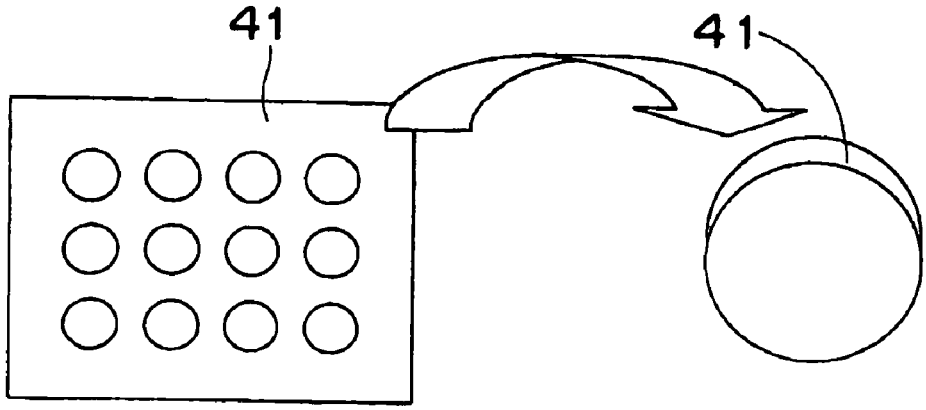
FIG. 11 is an explanatory view showing portions where dirt tends to remain macroscopically indicated by arrows.

More concretely, concrete examples of places 40 where the dirt of the component that is the object to be cleaned or a thing to be cleaned is left are macroscopically the neighborhoods of the locations bent by press molding as shown in FIG. 10A and microscopically the sharp projections and depressions (in other words, roughened portions of the material surface) as shown in FIG. 10B and, in particular, the portions where the solvent for cleaning is hard to enter in the case of the deep-drawn products of press molds. Moreover, in the case of punched products of press molds, the place is macroscopically a portion 41 brought in contact with the blade for punching during punching and microscopically the sharp projections and depressions (in other words, roughened portions of the material surface) as shown in FIG. 11 and, in particular, the portions where the solvent for cleaning is hard to enter.

Moreover, examples of adhering substances of which dirt is particularly hard to remove and which can be cleaned by the cleaning method and apparatus of the present invention include a lubricating oil used during the press molding and, in particular, a lubricating oil rubbed onto the material and a lubricating oil processed and degenerated by heat applied in the case where the adhering substances are press molding oils (coating type). Moreover, in the case of a material precoating type lubricating oil, the adhering substances are the lubricating oil precoated on the surface of a material by the material manufacturer, the material being precoated with a lubricating oil for press molding instead of coating the oil during press molding.

As the material of the component that is the object to be cleaned or the thing to be cleaned of the cleaning method and apparatus of the present invention, there are stainless steels, aluminum, titanium, iron, and so on in the case of metals. Particularly, iron and so on, which easily rust and require no drying, are therefore suitable as the material of the component that is the object to be cleaned or the things to be cleaned by the cleaning method and apparatus of the present invention. Besides the materials, there are complex materials of a metal and an organic matter obtained by sheet-bonding or coating an organic matter (PPT, PET, and so on) to or on the metal surface.

Figure 12:
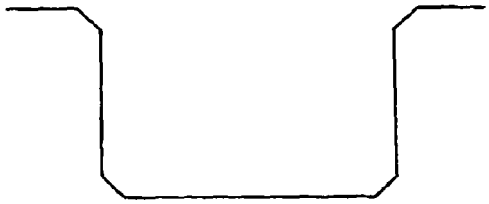
FIG. 12 is a schematic sectional view of an ultrasonic sensor casing of another example of the object to be cleaned according to a cleaning method of the first embodiment of the present invention.

Moreover, FIG. 12 shows the configuration of another ultrasonic casing as another example of the object to be cleaned.

First of all, carbon dioxide or water in the liquefied state (including the subcritical fluid) that has high permeability and some degree of viscosity is introduced as the cleaning medium into the high pressure vessel 1. Particularly, carbon dioxide enters the liquid state at a comparatively low temperature and low pressure. Therefore, by controlling the temperature and the pressure by the motion control of the liquid pump 3 and the heater controller 4 by the control unit 1000, a physical property change between the liquid state and the gaseous state (in this case, with regard to the physical property change, the density changes by three to four orders of magnitude from 0.6-1 kg/M$^3$ to 1000 kg/m$^3$, the viscosity changes by two orders of magnitude from $10^{-5}$ Ps·s to $10^{-3}$ Ps·s, the diffusion coefficient changes by four or more orders of magnitude from $10^{-5}$ to $10^{-9}$ or less, and the thermal conductivity changes by two orders of magnitude from $10^{-3}$ to $10^{-1}$ if, for example, gas and liquid are compared with each other) or a change of state from the liquid state to the gaseous state or from the gaseous state to the liquid state can be easily produced.

Moreover, carbon dioxide and water can easily be handled since they are harmless in human physical terms.

Furthermore, carbon dioxide and water have the effects of resolving and removing the organic matters in the critical state, and water has the effect of etching oxides and so on at a specified pressure and temperature state. Therefore, utilizing their features is effective for cleaning the component that has the recess structure.

In this case, the mechanisms that carbon dioxide has the effects of resolving and removing the organic matters in the supercritical state and water has the effect of etching oxides are currently not clearly understood. However, it is attributed to having solvency that can be expressed by a function of density, macroscopic average characteristics of equilibrium properties of ionic product and so on, and local structures such as salvation (cluster) on the molecular level. Particularly, it is fairly recently that the effects are attributed to the salvation structures formed around the solute molecules. If solute molecules exist in a supercritical fluid cylinder where thermal motions contend with intermolecular forces, then a solute-solvent interaction becomes relatively dominant and the solvent molecules are attracted to the peripheries of the solute molecules to cause solvation, so that the neighborhoods of the solute molecules come to have a higher density compared to bulk. This is considered to be intimately related to the characteristic phenomenon of high selectivity of the solvency of the supercritical fluid, promotion in the reaction rate, and so on.

Figure 9:
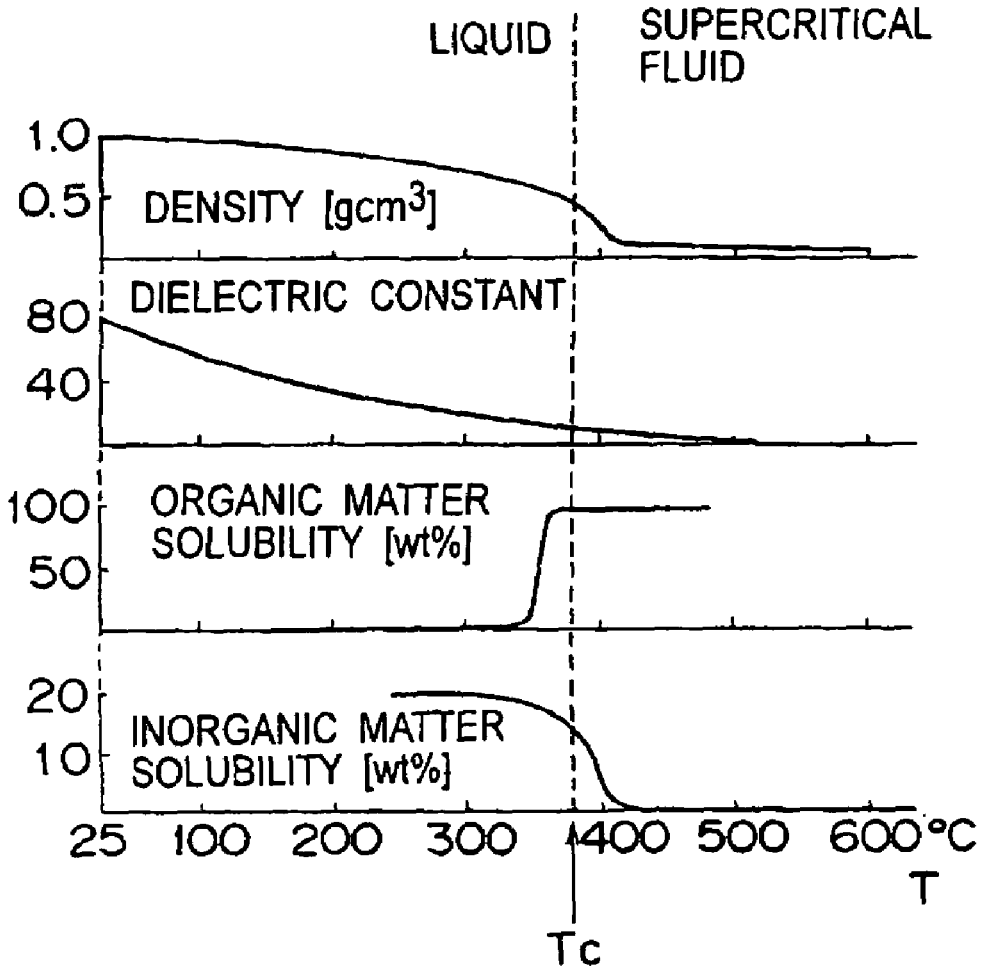
FIG. 9 is an explanatory view showing the temperature dependence of the physical properties of water.

Moreover, with regard to the effect of etching oxides by water, the temperature dependence (pressure is made constant at 25 Mpa) of the physical properties of water is shown in FIG. 9. The dielectric constant of water at room temperature has a very large value of about 80.

Therefore, inorganic matters such as electrolytes are well dissolved, whereas organic matters are hardly dissolved. However, if the temperature is raised, then the dielectric constant gradually reduces and comes to have a value of about 10 equivalent to that of an organic solvent of a small polarity in the case of supercritical water at a temperature of not lower than 374° C. As a result, the organic matters are well dissolved, whereas the inorganic matters are hardly dissolved. By skillfully utilizing such the physical property change state, the effect can be obtained even at a pressure of about 5 to 10 Mpa at and around a temperature of about 200° C. in the case of etching of the inorganic matters of oxides and so on.

The cleaning of such the component that has the recess structure of the object to be cleaned by means of the cleaning system shown in FIG. 3 will be described. In this case, FIGS. 4A and 4B are similar to the phase diagram of the cleaning medium shown in FIG. 1.

The object to be cleaned, which is the component (electronic component, in particular) that has undergone press molding, is accommodated in the high pressure vessel 1 with the processing oil and impurities adhering thereto. After the component is introduced into the high pressure vessel 1, changes of state are effected from the liquid state to the gaseous state and from the gaseous state to the liquid state by changing either one of temperature or pressure.

Figure 4A:
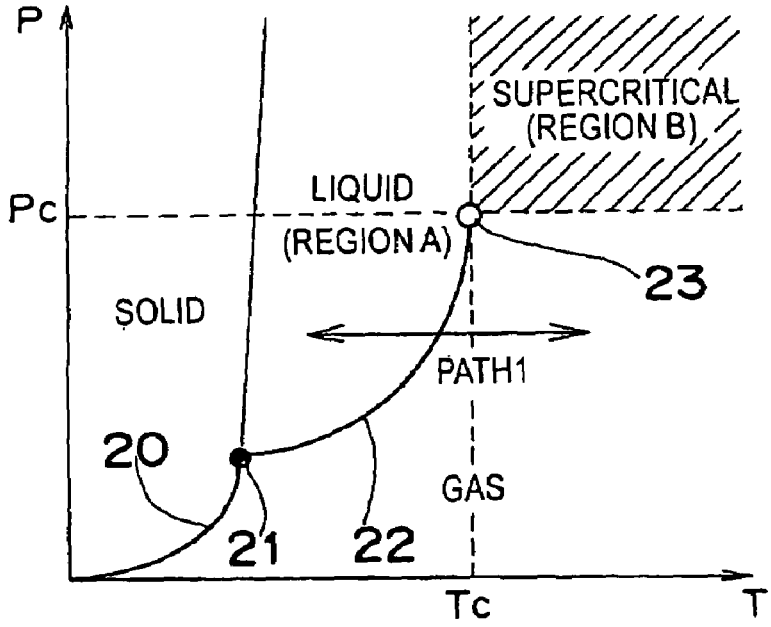
FIGS. 4A and 4B are graphs showing the cleaning processes of the first embodiment of the present invention.
Figure 4B:
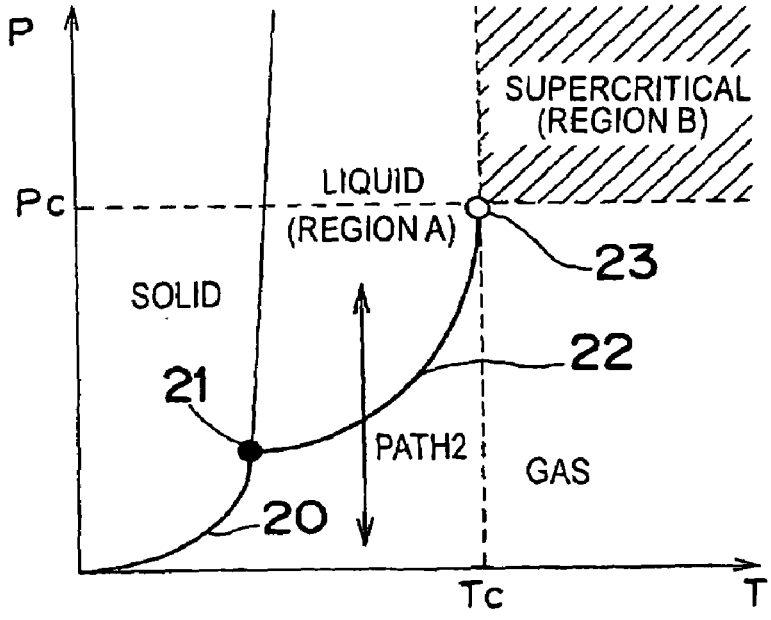

For example, in a path 1 shown in FIG. 4A, the liquid state changes into the gaseous state when the temperature is raised with the pressure kept constant, and the state changes into the liquid state when the temperature is set back (lowered). In a path 2 shown in FIG. 4B, the liquid state changes into the gaseous state when the pressure is reduced with the temperature kept constant, and the gaseous state returns to the liquid state when the pressure is increased from the state. If this process is repeated again and again, then a physical energy (With regard to physical property change, the density changes by three to four orders of magnitude from 0.6-1 kg/m$^3$ to 1000 kg/M$^3$, the viscosity changes by two orders of magnitude from $10^{-5}$ Ps·s to $10^{-3}$ Ps·s, the diffusion coefficient changes by four or more orders of magnitude from $10^{-5}$ to $10^{-9}$ or less, and the thermal conductivity changes by two orders of magnitude from $10^{-3}$ to $10^{-1}$ if, for example, liquid and gas are compared with each other. It is considered that the energy is, among them, specifically, a physical energy caused by change in surface tension accompanied with density change and viscosity change.) acts on the processing oil and impurities (swarf and so on) particularly during the change from the liquid state to the gaseous state, reducing the adhesive powers of the processing oil and impurities (swarf and so on) that adhere to the component and improving the cleaning effect.

Figure 5:
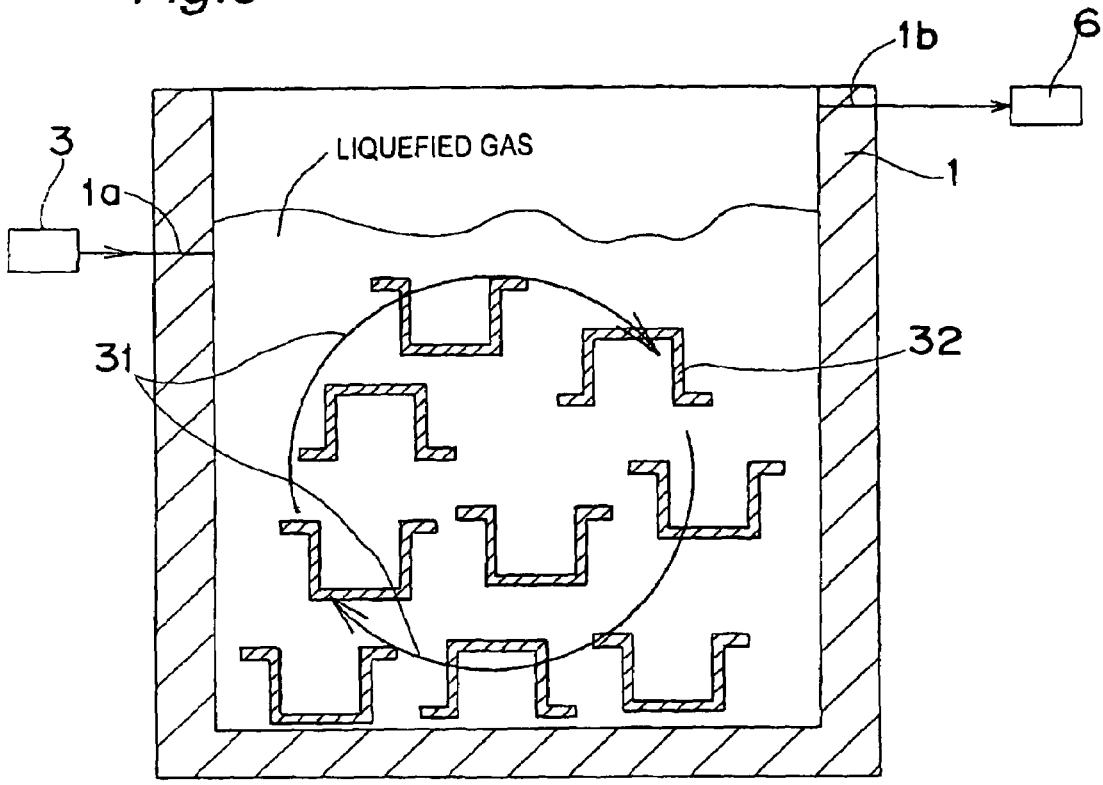
FIG. 5 is a sectional view showing the cleaning state of the first embodiment of the present invention.

Moreover, by repeating the liquid state and the gaseous state, convection (arrows 31) of the liquefied gas is caused in the high pressure vessel as shown in FIG. 5, and the liquefied gas of the cleaning agent infiltrates even to the corners of the component 32 that has recess portions, improving the cleaning effect.

Subsequently, temperature and pressure are changed so as to exceed the critical point, making a shift into the supercritical state to carry out main cleaning. At this time, the liquefied gas is discharged out of the high pressure vessel after undergoing the process of repeating the gaseous state and the liquid state several times, and after the liquefied gas is newly introduced, the temperature or the pressure is changed so as to exceed the critical point temperature or the critical point pressure, making a shift to the cleaning process in the supercritical state. In the supercritical state, resolution and removal of organic matters and the etching of inorganic oxides are mainly carried out in specified temperature and pressure states (in the case where water is used).

Moreover, it is possible to carry out the cleaning only by the cleaning process of repeating the liquid state and the gaseous state even without the use of the supercritical state depending on the contamination level of the component that is the object to be cleaned.

If explanation is made by using "Sample 2" shown in the report of "General cleaning level evaluation method and classification of indexes of the cleaning levels" by Japan Industrial Conference on Cleaning in fiscal year 1994, the cleaning level of components here indicates the "rough cleaning" level or the "general cleaning" level described.

The cleaning apparatus of the first embodiment of the present invention is provided with the high pressure vessel 1, the liquid pump 3 that introduces a supercritical gas and a liquefied gas into the high pressure vessel 1, the heater controller 4 and the heater 5 that control the temperature of the supercritical gas and the liquefied gas in the high pressure vessel 1, the extraction and collection vessel 8 that collects the removed substances after cleaning, and the control unit 1000. As shown in FIGS. 3 and 5, an inlet port 1*a* for introducing the liquefied gas into the high pressure vessel 1 is surely provided on the lower side of an outlet port 1*b* for discharging the liquefied gas from the inside of the high pressure vessel 1, and the outlet port 1*b* is further provided on the upper side of the object to be cleaned 32. This is because the specific gravity of the object to be cleaned 32 is heavier than the specific gravity of the cleaning gas mainly in the liquid state or the supercritical state, and in contrast to this, the specific gravity of the dirt of the organic system and the oxide of the inorganic system are smaller than the specific gravity of the cleaning gas. Therefore, the organic matters and the inorganic matters, which are contaminants, tend to float above the object to be cleaned in the liquid state or the supercritical state. The reason for the necessity of locating the inlet port 1*a* on the lower side of the outlet port 1*b* is that the liquefied gas of the cleaning gas is evenly spread over the component that has the recess structure of the object to be cleaned 32.

On the other hand, the reason for the necessity of locating the outlet port 1*b* above the inlet port 1*a* is that the adhering substances or contaminants once removed from the object to be cleaned 32 is prevented from adhering again to the object to be cleaned 32.

Components that are expected to have a cleaning effect by the cleaning method and the cleaning apparatus of the first embodiment of the present invention are mainly electronic components used for electronics and associated components. The components are, in particular, precision-machined components obtained by press molding and cutting. A lubricating oil, which is always the processing oil, is necessary and indispensable for these components in order to improve the machining accuracy. However, the remaining of this processing oil influences the performance characteristics of the processing in the next process such as plating and bonding and causes reductions in the performance and reliability of the device and the product. Therefore, effects are produced for the high-level removal of the adhering substances, i.e., for the components that require precision cleaning.

Application commodities to which the present invention is applied are the matching layers of ultrasonic sensors and electrodes of cells (particularly, secondary cells and so on) in addition to other commodities of casings for cells, casings (also called housings) for HDD's, and casings for electrolytic capacitors. The matching layers for ultrasonic sensors and so on have numbers of minute holes and unevenness formed, and recess structures are microscopically formed. Then, in concrete, there are used various materials such as a mixture of glass balloons of the inorganic system and epoxy resin of the organic system, the single material of the glass balloons of the inorganic system and the single material of epoxy resin of the organic system.

Moreover, the casings for the ultrasonic sensors and so on are made of a material of stainless steel, aluminum, or epoxy resin. With regard to the processing, they are processed by deep drawing by press molding, resin molding or cutting. With regard to the casings for cells, there is generally used aluminum or recently used a multi-layer steel material of plated aluminum, and they are produced by press molding. With regard to the casings for HDD's, there is used a material of aluminum or recently particularly used a complex steel material obtained by coating aluminum with a coating of the organic system, and they are processed by press molding. The casings for electrolytic capacitors are similarly obtained by press molding a single material of aluminum or a complex steel sheet obtained by coating an aluminum material with an organic coating film.

As described above, the present invention is applicable by selecting the processes and the gas type of the cleaning medium to be used also for a complex material in which different materials of organic matters and inorganic matters are laminated. It is beyond the argument that the present invention is not limited to these products and fields, and the effects are produced also for the components that have recess structures processed by press molding and cutting.

That is, according to the cleaning method of the first embodiment, the change of state of the cleaning medium is effected alternately between the liquid state and the gaseous state by changing the temperature and the pressure of the cleaning medium, so that the cleaning medium evenly spreads over the surface of the recess structure. Moreover, after effecting the change of state alternately between the liquid state and the gaseous state of the cleaning medium at need, the cleaning of the surface of the recess structure is carried out by changing the state of the cleaning medium into the supercritical state. Otherwise, after effecting the change of state alternately between the liquid state and the gaseous state of the cleaning medium, the cleaning of the surface of the recess structure is carried out by changing the state of the cleaning medium into the sub-supercritical state.

If this is put in order, the methods of evenly spreading the cleaning medium over the component include the following seven methods for spreading by convection with the pressure or the temperature changed. These methods can each be carried out by the control unit 1000 by the motion control of the liquid pump 3 and the heater controller 4 for the control of the temperature and the pressure.

(1) After carrying out at least one cycle or more of (liquid-gas) change as one cycle, temperature is controlled to the supercritical state.

(2) After carrying out at least one cycle or more of (gas-liquid) change as one cycle, pressure is controlled to the supercritical state.

(3) After carrying out at least one cycle or more of (liquid-gas-liquid) change as one cycle, temperature is controlled to the supercritical state.

(4) After carrying out at least one cycle or more of (gas-liquid-gas) change as one cycle, pressure is controlled to the supercritical state.

(5) After carrying out at least one cycle or more of (liquid-supercritical) change as one cycle, temperature is controlled to the supercritical state.

(6) After carrying out at least one cycle or more of (gas-supercritical) change as one cycle, pressure is controlled to the supercritical state.

(7) The supercritical state is established at least one time during one cycle of (1) to (6), and pressure or temperature is controlled.

Figure 13:
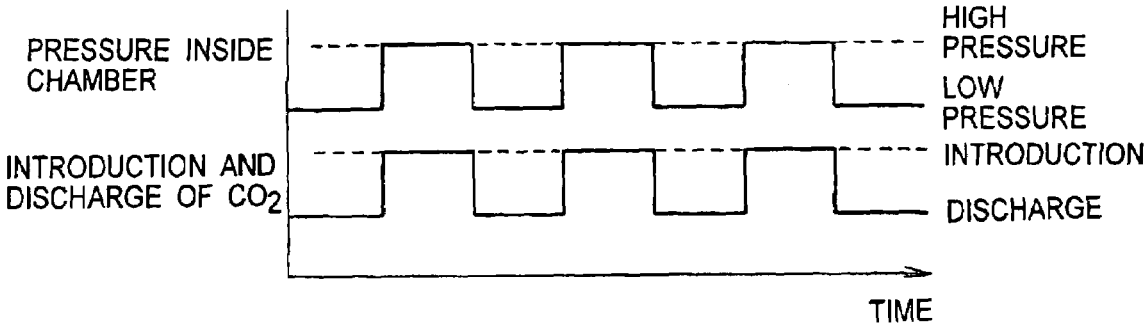
FIG. 13 is a timing chart during pressure control by the cleaning method of the first embodiment of the present invention.

FIG. 13 shows a timing chart of the pressure control by the control unit 1000 for the motion control of the liquid pump 3, in which the ordinate axis with respect to the time base on the abscissa axis represents the pressure inside the chamber and introduction and discharge of $CO_2$. $CO_2$ is introduced when the pressure inside the chamber is high, and $CO_2$ is discharged when the pressure inside the chamber is low. By periodically repeating the above operation, the pressure is controlled.

Figure 14:
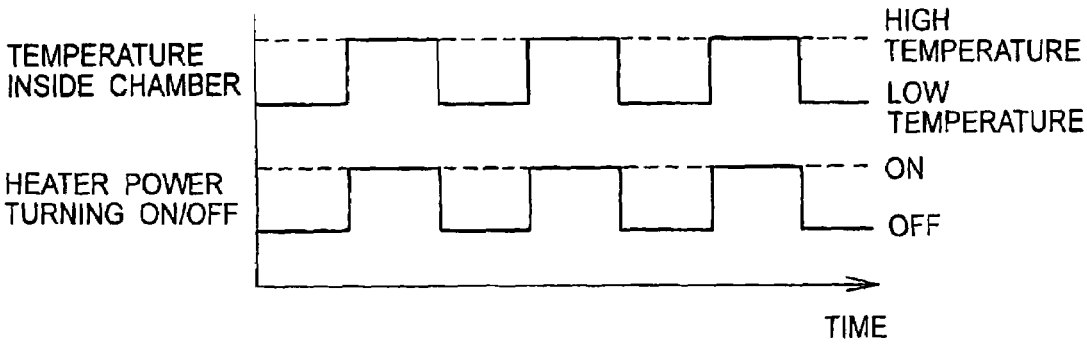
FIG. 14 is a timing chart during temperature control by the cleaning method of the first embodiment of the present invention.

FIG. 14 shows a timing chart of the temperature control by the control unit 1000 for the motion control of the heater controller 4, in which the ordinate axis with respect to the time base on the abscissa axis represents the temperature inside the chamber and the ON/OFF state of heater power. The heater power is turned on in raising the temperature inside the chamber, and the heater power is turned off in lowering the temperature inside the chamber. By periodically repeating the above operation, the temperature is controlled.

Figure 15:
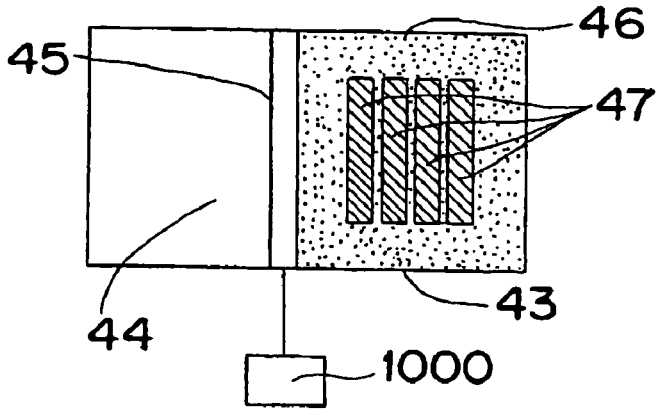
FIG. 15 is an explanatory view when the pressure is increased by means of a dual compartment type chamber of a cleaning apparatus according to a modification example of the first embodiment of the present invention.
Figure 16:
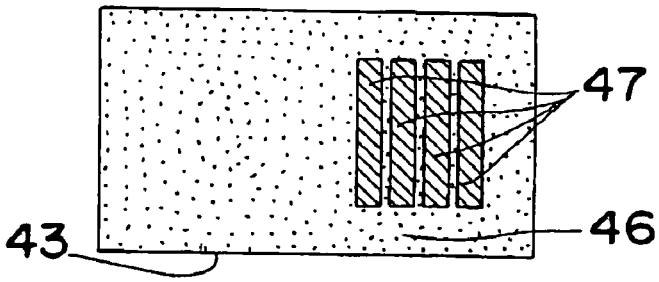
FIG. 16 is an explanatory view of a state in which the partition that separates the chamber into two compartments is opened in reducing the pressure by means of the dual compartment type chamber in the cleaning apparatus according to the modification example of the first embodiment of the present invention.

As another method of the pressure control, it can be considered to use a dual compartment type chamber constructed of a main chamber 43 and a sub-chamber 44, make the pressure easy to rise by closing a partition 45 that separates the compartments as shown in FIG. 15 under the motion control of the control unit 1000 in raising the pressure and open the partition 45 that separates the compartments as shown in FIG. 16 under the motion control of the control unit 1000 in reducing the pressure. In FIGS. 15 and 16, there are shown a cleaning medium 46 and an object 47 to be cleaned.

Figure 17:
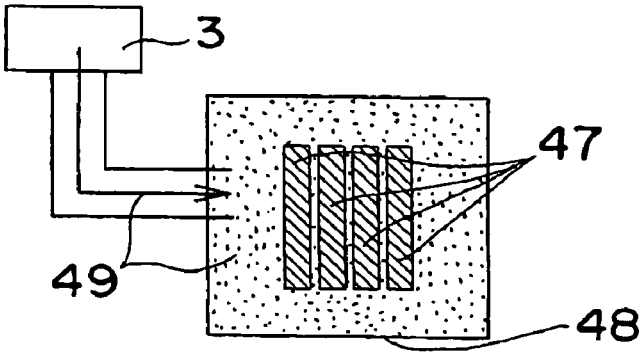
FIG. 17 is an explanatory view of a state in which a heating medium in a liquid state is supplied in a cleaning apparatus according to a modification example of the first embodiment of the present invention.
Figure 18:
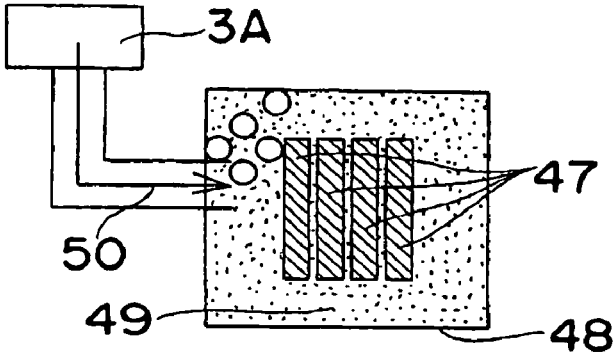
FIG. 18 is an explanatory view of a state in which a heating medium in a gaseous state is supplied in a cleaning apparatus according to a modification example of the first embodiment of the present invention.

Furthermore, as another method of temperature control, as shown in FIG. 17, it is also possible to control the cleaning medium 49 in the main chamber 48 to a prescribed temperature by introducing the cleaning medium 49 of a temperature that is higher or lower than the temperature of the cleaning liquid 49 in the liquid state into the cleaning liquid 49 in the main chamber 48 by means of the liquid pump 3. Moreover, as shown in FIG. 18, it is also possible to control the cleaning liquid 49 in the main chamber 48 to a prescribed temperature by introducing a cleaning medium 50 of a temperature that is higher or lower than the temperature of the cleaning liquid 49 in the gaseous state into the main chamber 48 by means of a pump 3A that takes the place of the pump 3.

Figure 19:
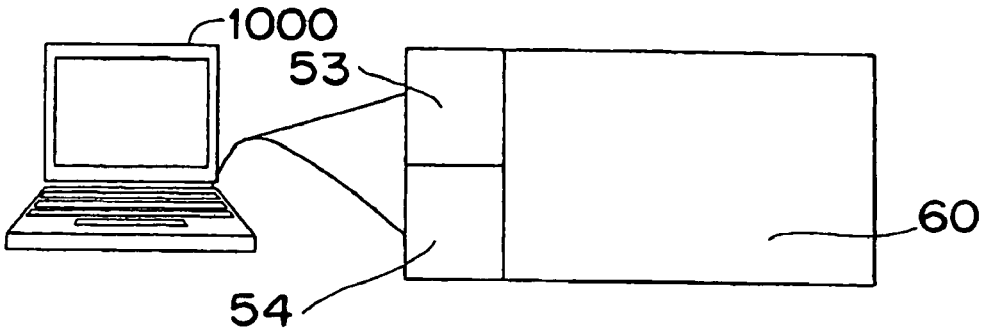
FIG. 19 is an explanatory view showing the relation among a control unit, a temperature control relay, and a pressure control relay in the cleaning apparatus of the first embodiment of the present invention.

FIG. 19 is an explanatory view showing a control unit 1000 with a built-in control program for the motion control of the aforementioned cleaning method, a relay 53 for controlling the temperature inside the heater controller 4 of which the operation is controlled by the control unit 1000, a relay 54 for controlling the pressure inside the liquid pump 3 of which the operation is controlled by the control unit 1000, and the above cleaning apparatus 60.

Figure 20:
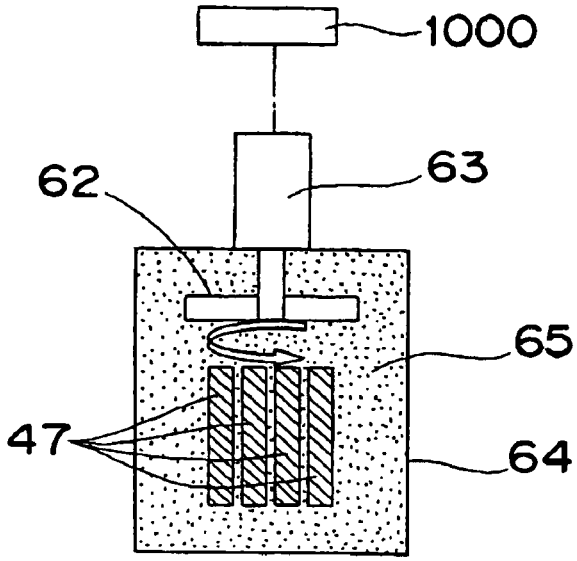
FIG. 20 is an explanatory view of a state in which a stirring propeller is rotated in order to improve a cleaning efficiency in a cleaning apparatus according to a modification example of the first embodiment of the present invention.

As shown in FIG. 20, as one example of the method of improving the cleaning efficiency in the first embodiment, it is acceptable to rotate a rotor (propeller for stirring) 62 arranged on the ceiling side of a main chamber 64 by means of a motor 63 under the control of the control unit 1000 and stir a cleaning medium 65 in the main chamber 64 to increase the cleaning efficiency of the object 47 to be cleaned by the cleaning medium 65.

Figure 21:
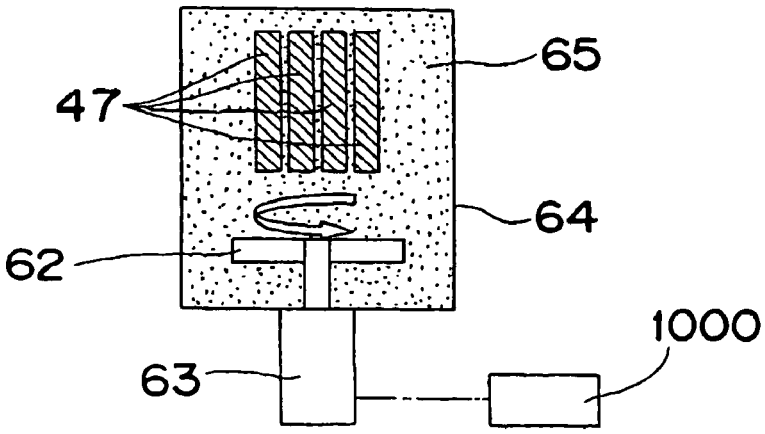
FIG. 21 is an explanatory view of a state in which a stirring propeller is rotated in order to improve the cleaning efficiency in a cleaning apparatus according to a modification example of the first embodiment of the present invention.

Moreover, as shown in FIG. 21, as another example of the method of improving the cleaning efficiency in the first embodiment, it is acceptable to rotate the rotor (propeller for stirring) 62 arranged on the bottom side of the main chamber 64 by means of the motor 63 under the control of the control unit 1000 and stir the cleaning medium 65 in the main chamber 64 to increase the cleaning efficiency of the object 47 to be cleaned by the cleaning medium 65.

Figure 22:
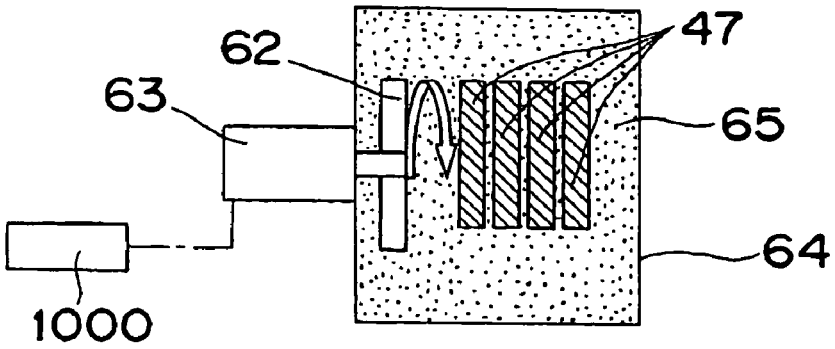
FIG. 22 is an explanatory view of a state in which a stirring propeller is rotated in order to improve the cleaning efficiency in a cleaning apparatus according to a modification example of the first embodiment of the present invention.

Moreover, as shown in FIG. 22, as another example of the method of improving the cleaning efficiency in the first embodiment, it is acceptable to rotate the rotor (propeller for stirring) 62 arranged on a side surface of the main chamber 64 by means of the motor 63 under the control of the control unit 1000 and stir the cleaning medium 65 in the main chamber 64 to increase the cleaning efficiency of the object 47 to be cleaned by the cleaning medium 65.

Figure 23:
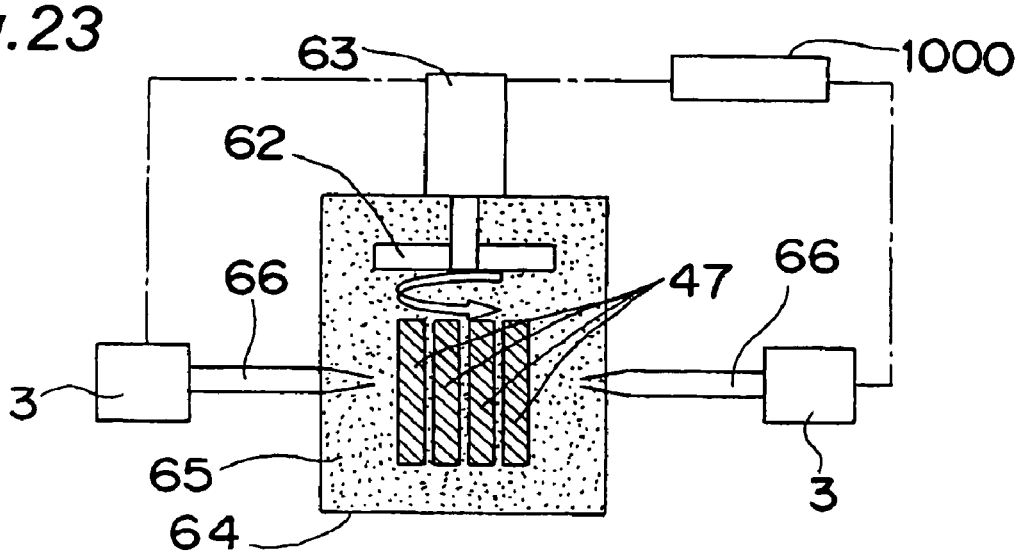
FIG. 23 is an explanatory view of a state in which a stirring propeller is rotated and a cleaning medium is additionally supplied from nozzles in order to improve the cleaning efficiency in a cleaning apparatus according to a modification example of the first embodiment of the present invention.

Moreover, as shown in FIG. 23, as another example of the method of improving the cleaning efficiency in the first embodiment, it is acceptable to rotate the rotor (propeller for stirring) 62 arranged on the ceiling side of the main chamber 64 by means of the motor 63 under the control of the control unit 1000, stir the cleaning medium 65 in the main chamber 64 and introduce the cleaning medium into the main chamber 64 from a pair of nozzles 66 arranged on opposite side surfaces of the main chamber 64 by driving the liquid pump 3 under the control of the control unit 1000 to increase the cleaning efficiency of the object 47 to be cleaned by the cleaning medium 65.

Figure 24:
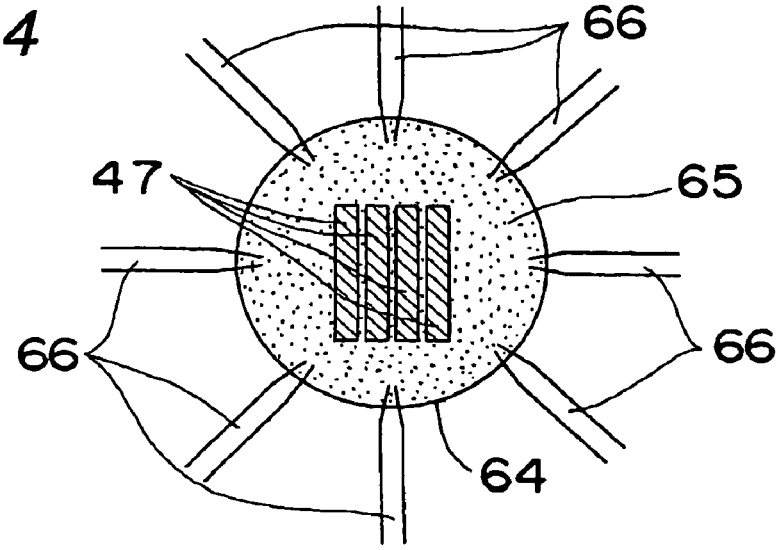
FIG. 24 is an explanatory view of a state in which a cleaning medium is supplied from nozzles in order to improve the cleaning efficiency in a cleaning apparatus according to a modification example of the first embodiment of the present invention.

Moreover, as shown in FIG. 24, as yet another example of the method of improving the cleaning efficiency in the first embodiment, it is acceptable to introduce the cleaning medium into the main chamber 64 from a plurality of nozzles 66 arranged radially on the cylindrical side surface of the main chamber 64 by driving the liquid pump 3 under the control of the control unit 1000 to increase the cleaning efficiency of the object 47 to be cleaned by the cleaning medium 65.

Figure 25:
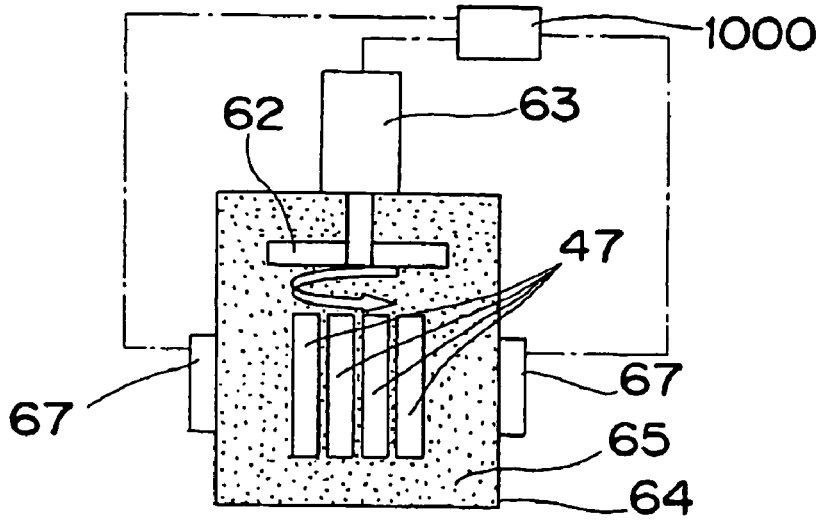
FIG. 25 is an explanatory view of a state in which a stirring propeller is rotated and ultrasonic waves are additionally supplied from an ultrasonic sensor in order to improve the cleaning efficiency in a cleaning apparatus according to a modification example of the first embodiment of the present invention.

Moreover, as shown in FIG. 25, as yet another example of the method of improving the cleaning efficiency in the first embodiment, it is acceptable to apply ultrasonic vibrations to the cleaning medium 65 from the side surfaces of the main chamber 64 by driving concurrently or sequentially a pair of ultrasonic sensors 67 arranged on mutually opposite side surfaces of the main chamber 64 under the control of the control unit 1000 to increase the cleaning efficiency of the object 47 to be cleaned by the cleaning medium 65.

Figure 26:
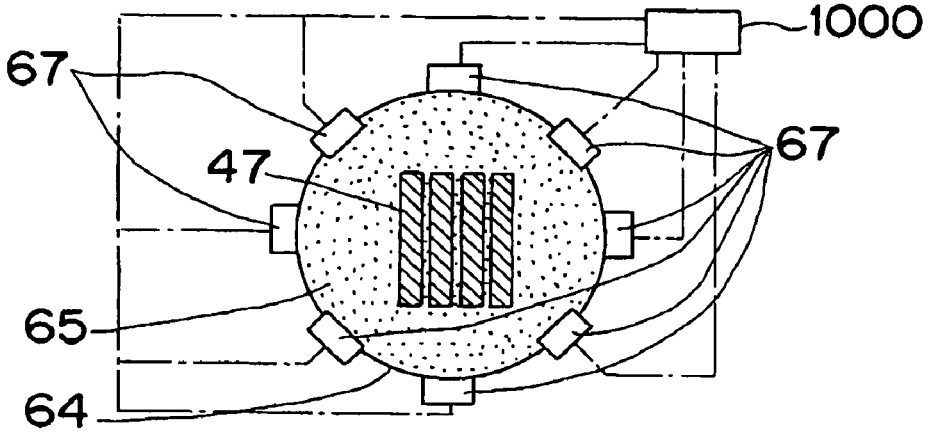
FIG. 26 is an explanatory view of a state in which ultrasonic waves are supplied from an ultrasonic sensor in order to improve the cleaning efficiency in a cleaning apparatus according to a modification example of the first embodiment of the present invention.

Moreover, as shown in FIG. 26, as yet another example of the method of improving the cleaning efficiency in the first embodiment, it is acceptable to apply ultrasonic vibrations to the cleaning medium 65 from the side surface of the main chamber 64 by driving concurrently or sequentially a number of ultrasonic sensors 67 arranged radially on the cylindrical side surface of the main chamber 64 under the control of the control unit 1000 to increase the cleaning efficiency of the object 47 to be cleaned by the cleaning medium 65.

Figure 28:
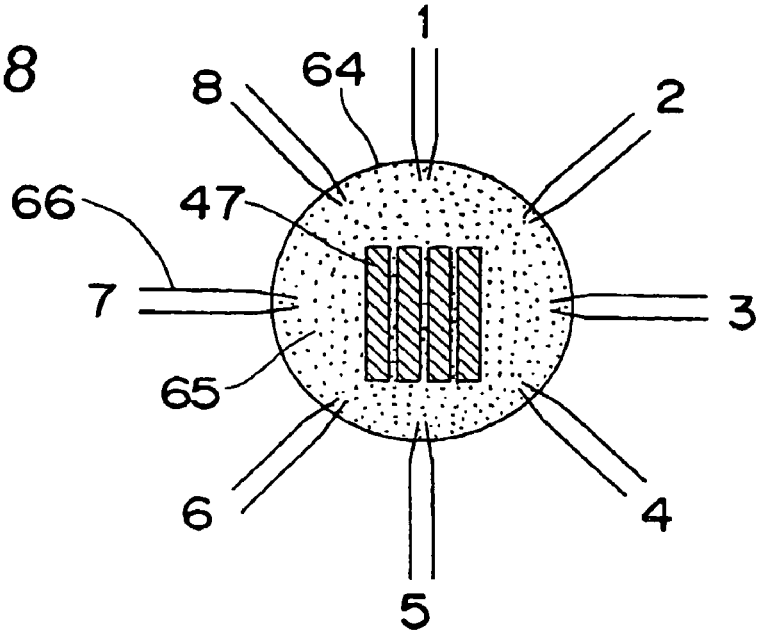
FIG. 28 is an explanatory view of a state in which a cleaning medium is sequentially supplied from a plurality of nozzles to generate convection in order to improve the cleaning efficiency in a cleaning apparatus according to a modification example of the first embodiment of the present invention.

Moreover, as shown in FIG. 28, as yet another example of the method of improving the cleaning efficiency in the cleaning apparatus of FIG. 24, it is acceptable to sequentially introduce the cleaning medium into the main chamber 64 from a plurality of nozzles 66 arranged radially on the cylindrical side surface of the main chamber 64 under the control of the control unit 1000 to increase the cleaning efficiency of the object 47 to be cleaned by the cleaning medium 65. In this case, the cleaning efficiency can be further improved by generating convection in the main chamber 64 by sequentially introducing the cleaning medium from the nozzles 66 into the main chamber 64 in the order of the nozzle numbers 1 to 8 or in the order of the nozzle numbers 8 to 1 shown in FIG. 28. By providing each nozzle with an on-off valve or a shutter and controlling the motion of the on-off valve or the shutter by means of the control unit 1000, it is possible to arbitrarily control the cleaning medium introducing order, the on/off duration, the jet pressure, and the jet quantity.

Figure 27A:
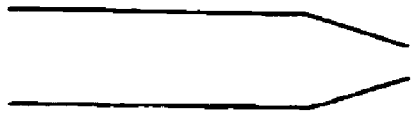
FIGS. 27A, 27B and 27C are schematic sectional views showing various nozzle configurations in a cleaning apparatus according to a modification example of the first embodiment of the present invention.
Figure 27B:
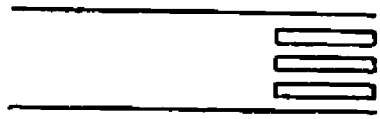
Figure 27C:
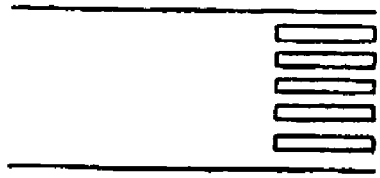

With regard to the nose shape of each of the nozzles 66 of the first embodiment, shapes as shown in FIGS. 27A through 27C are preferable. With regard to the nozzle configuration, as shown in FIGS. 27A through 27C, there is provided a structure in which the stirring efficiency is improved in accordance with the object to be cleaned by changing the energy density of the fluid jetted from the nozzles by changing the number of separations of the blowoff opening, the jet pressure, and the duration of jetting. For example, since the impurities can easily be removed even if the stirring is effected a little when the size of the object to be cleaned is large and the structure is simple, there is no problem with a simple nozzle configuration as shown in FIG. 27A. On the other hand, when the size of the object to be cleaned is small and the structure is complicated, there is adopted a nozzle configuration of a higher stirring effect as shown in FIGS. 27B and 27C according to the size and the complexity. Moreover, when the object to be cleaned is a very high precision optical component or a very fragile object, it is desirable to change the nozzle configuration, the jet pressure and the duration of jetting in accordance with the object to be cleaned. Although the configurations are illustrated merely two-dimensionally in the figures, each of the configurations actually has a three-dimensional structure.

The effects of the aforementioned first embodiment of the present invention will be described below on the basis of concrete working examples.

WORKING EXAMPLE 1

Figure 6:
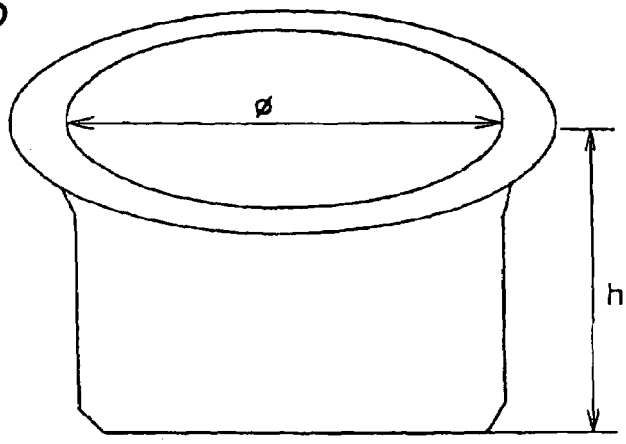
FIG. 6 is an explanatory view showing an object to be cleaned according to a first working example of the first embodiment of the present invention.

Cleaning of casings that have undergone press molding and cutting was carried out. Carbon dioxide was used as a liquefied gas for the cleaning. As shown in FIG. 6, the material is SUS304 and has a recess structure of dimensions of a diameter ϕ of 12 mm and a height h of 5 mm. The amount of residue (oil content) and the amount of particles depending on the difference of the cleaning process were examined by using the casings. With regard to the cleaning processes, there were examined the seven processes of: (1) solvent cleaning (1-bromopropane); (2) cleaning in the liquid state with the temperature kept constant and the pressure changed; (3) cleaning by changing the state between the gaseous state and the liquid state five times with the temperature kept constant and the pressure changed; (4) supercritical cleaning only; (5) supercritical cleaning after the process of (2); (6) supercritical cleaning after the cleaning of (3); and (7) cleaning in the liquid state after cleaning in the supercritical state. During each of the cleaning processes, one hundred casings were cleaned and analyzed. The residual oil content analysis was carried out by extracting oil content with a solvent (carbon tetrachloride) and thereafter measuring the extracted oil content by FT-IR (Fourier transform infrared spectroscopy). Moreover, the particles were measured by means of a particle analyzer (Wafer Surface Analyzer WM-1700/1500 produced by Topcon) after the cleaning. Table 1 shows the results.

TABLE 1

| Cleaning Process | Amount of Residual Oil Content | Amount of Particles |
|---|---|---|
| (1) | 0.7 mg/100 casings | 500 particles/cm$^2$ |
| (2) | 0.4 mg/100 casings | 250 particles/cm$^2$ |
| (3) | 0.3 mg/100 casings | 150 particles/cm$^2$ |
| (4) | 0.3 mg/100 casings | 100 particles/cm$^2$ |
| (5) | 0.2 mg/100 casings | 70 particles/cm$^2$ |
| (6) | 0.1 mg/100 casings | 30 particles/cm$^2$ |
| (7) | 0.3 mg/100 casings | 100 particles/cm$^2$ |

According to the aforementioned results, low values are obtained with regard to both the amount of residual oil content and the amount of particles in comparison with those of the solvent cleaning. Moreover, it was found that the cleaning effect was further improved also in removing the particles of the inorganic system by combining the gaseous state, the liquid state, and the supercritical state of carbon dioxide with the pressure changed.

WORKING EXAMPLE 2

Cleaning of casings that have undergone press molding and cutting was carried out similarly to Working Example 1. Carbon dioxide was used as a liquefied gas for the cleaning. As shown in FIG. 6, the material is SUS304 and has a recess structure of dimensions of a diameter ϕ of 12 mm and a height of 5 mm. The amount of residue (oil content) and the amount of particles depending on the difference of the cleaning process were examined by using the casings. With regard to the cleaning processes, there were examined the five processes of: (1) cleaning in the liquid state with the pressure kept constant and the temperature changed; (2) cleaning by changing the state between the gaseous state and the liquid state five times with the pressure kept constant and the temperature changed; (3) supercritical cleaning only; (4) supercritical cleaning after the process of (1); and (5) supercritical cleaning after the cleaning of (2). During each of the cleaning processes, one hundred casings were cleaned and analyzed. The residual oil content analysis was carried out by extracting oil content with a solvent (carbon tetrachloride) and thereafter measuring the extracted oil content by FT-IR (Fourier transform infrared spectroscopy). Moreover, the particles were measured by means of a particle analyzer (Wafer Surface Analyzer WM-1700/1500 produced by Topcon) after the cleaning. Table 2 shows the results.

TABLE 2

| Cleaning Process | Amount of Residual Oil Content | Amount of Particles |
|---|---|---|
| (1) | 0.4 mg/100 casings | 238 particles/cm$^2$ |
| (2) | 0.3 mg/100 casings | 148 particles/cm$^2$ |
| (3) | 0.3 mg/100 casings | 105 particles/cm$^2$ |
| (4) | 0.2 mg/100 casings | 73 particles/cm$^2$ |
| (5) | 0.1 mg/100 casings | 48 particles/cm$^2$ |

According to the aforementioned results, low values are obtained with regard to both the amount of residual oil content and the amount of particles also when the cleaning is carried out by changing the temperature with the pressure kept constant similarly to the case where the change of physical properties and the change of state are effected by changing the pressure with the temperature kept constant. Therefore, it was found that the cleaning effect was further improved also in removing the particles of the inorganic system by combining the gaseous state, the liquid state, and the supercritical state of carbon dioxide with the temperature changed.

WORKING EXAMPLE 3

Figure 7:
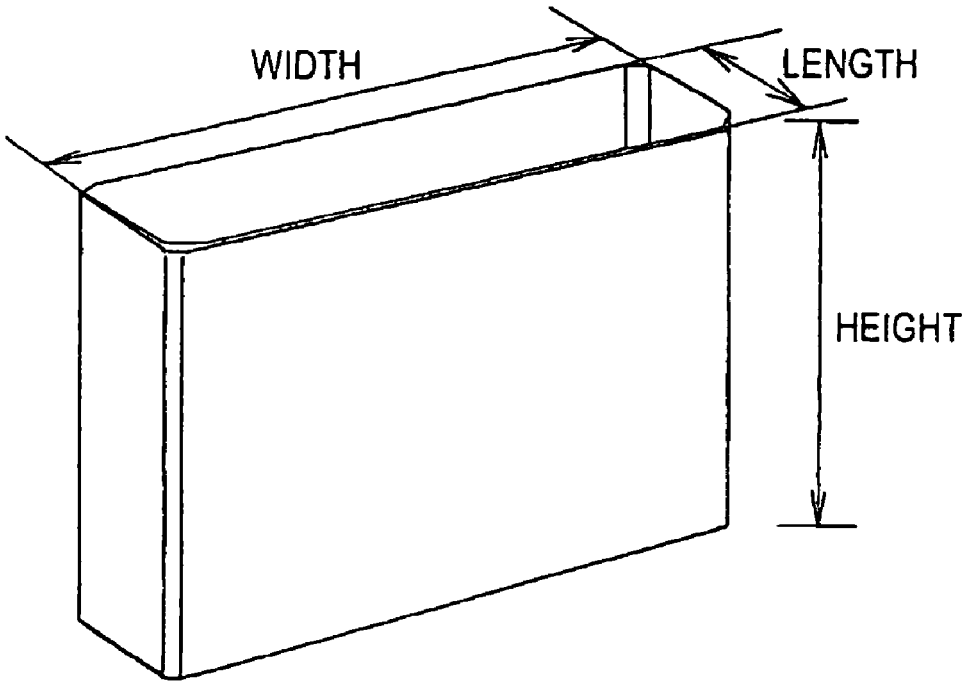
FIG. 7 is a perspective view showing an object to be cleaned according to a third working example of the first embodiment of the present invention.

Cleaning of casings of different materials was carried out by the process (6) "supercritical cleaning after repetitively changing the state between the gaseous state and the liquid state five times with the temperature kept constant and the pressure changed", which was the most effective cleaning method examined in connection with Working Example 1. The materials of the casings were: (1) aluminum; (2) composite plate of aluminum coated with an organic film; (3) stainless steel SUS304; (4) Cu; and (5) Ti. As shown in FIG. 7, the casing configuration has dimensions of 5 mm in length× 30 mm in width×50 mm in height. During each of the cleaning processes, one hundred casings were cleaned and analyzed. Carbon dioxide was used as a liquefied gas for the cleaning. The residual oil content analysis was carried out by extracting oil content with a solvent (carbon tetrachloride) and thereafter measuring the extracted oil content by FT-IR (Fourier transform infrared spectroscopy). Moreover, the particles were measured by means of a particle analyzer (Wafer Surface Analyzer WM-1700/1500 produced by Topcon) after the cleaning. Table 3 shows the results.

TABLE 3

| Component to be Cleaned | Amount of Residual Oil Content | Amount of Particles | External Appearance |
|---|---|---|---|
| (1) | 0.2 mg/ 100 casings | 35 particles/cm$^2$ | ○ |
| (2) | 0.2 mg/ 100 casings | 37 particles/cm$^2$ | ○ |
| (3) | 0.2 mg/ 100 casings | 33 particles/cm$^2$ | ○ |
| (4) | 0.2 mg/ 100 casings | 35 particles/cm$^2$ | ○ |
| (5) | 0.2 mg/ 100 casings | 33 particles/cm$^2$ | ○ |

The aforementioned results were evaluated by the amount of residual oil content, the amount of particles, and visual inspection, and a cleaning effect was obtained without any problem. Moreover, it was found that the cleaning was able to be effected without giving damages to the casing of different materials.

With a regard to the criteria of evaluation of the visual inspection and the amount of particles, if explanation is made by using "Sample 2" shown in the report of "General cleaning level evaluation method and classification of indexes of the cleaning levels" by Japan Industrial Conference on Cleaning in fiscal year 1994, the "general cleaning" level of the cleaning levels described there and cleaning levels higher than the level were indicated by the mark ○.

WORKING EXAMPLE 4

Cleaning of components of different materials was carried out by the process (6) "supercritical cleaning after repetitively changing the state between the gaseous state and the liquid state five times with the temperature kept constant and the pressure changed", which was the most effective cleaning method examined in connection with Working Example 1. The duration of cleaning was shortened since the material of the organic system was weaker than the metal system and the ceramic system. Carbon dioxide was used as a liquefied gas for the cleaning. The components have their configurations processed by press molding and cutting. The materials of the components are: (1) epoxy resin; (2) polyimide resin; (3) plastic; (4) a mixture of epoxy resin and glass balloons; (5) $Sio_2$; and (6) C (carbon). The component configuration has the dimensions of a diameter ϕ of 10.8 mm by a height of 1.15 mm. The visual inspection was carried out by SEM (Scanning Electron Microscopy), and the particles were measured by means of a particle analyzer (Wafer Surface Analyzer WM-1700/1500 produced by Topcon) after the cleaning. Table 4 shows the results.

TABLE 4

| Component to be Cleaned | Visual Inspection | Amount of Particles |
|---|---|---|
| (1) | ○ | ○ |
| (2) | ○ | ○ |
| (3) | ○ | ○ |
| (4) | ○ | ○ |
| (5) | ○ | ○ |
| (6) | ○ | ○ |

With regard to the criteria of evaluation of the visual inspection and the amount of particles, if explanation is made by using "Sample 2" shown in the report of "General cleaning level evaluation method and classification of indexes of the cleaning levels" by Japan Industrial Conference on Cleaning in fiscal year 1994, the "general cleaning" level of the cleaning levels described there and cleaning levels higher than the level were indicated by the mark ○.

WORKING EXAMPLE 5

Furthermore, cleaning was carried out by changing the structure of the high pressure vessel and the vessel fixation position of the object to be cleaned in order to further examine the cleaning effect and, in particular, the effect of preventing the readhesion of contaminants, and the amount of residual oil content and the amount of particles were measured. Carbon dioxide was used as a liquefied gas for the cleaning. The cleaning process was carried out by the process (6) "supercritical cleaning after repetitively changing the state between the gaseous state and the liquid state five times with the temperature kept constant and the pressure changed", which was the most effective cleaning method examined in connection with Working Example 1. The components are casings produced by press molding and have a configuration of the dimensions of 5 mm in length×30 mm in width×50 mm in height. The cleaning was carried out by changing the structure of the high pressure vessel and the fixation position of the object to be cleaned in the vessel as follows. There were evaluated the six arrangements of: (1) liquefied gas inlet port<object to be cleaned<liquefied gas outlet port; (2) liquefied gas inlet port >object to be cleaned>liquefied gas outlet port; (3) liquefied gas inlet port<liquefied gas outlet port<object to be cleaned; (4) object to be cleaned<liquefied gas inlet port<liquefied gas outlet port; (5) object to be cleaned<liquefied gas outlet port<liquefied gas inlet port; and (6) liquefied gas outlet port<liquefied gas inlet port<object to be cleaned. During each of the cleaning processes, one hundred casings were cleaned and analyzed. The residual oil content analysis was carried out by extracting oil content with a solvent (carbon tetrachloride) and thereafter measuring the extracted oil content by FT-IR (Fourier transform infrared spectroscopy). Moreover, the particles were measured by means of a particle analyzer (Wafer Surface Analyzer WM-1700/1500 produced by Topcon) after the cleaning. Table 5 shows the results.

TABLE 5

| Vessel Structure and Position of Object to be Cleaned | Amount of Residual Oil Content | Amount of Particles |
|---|---|---|
| (1) | 0.1 mg/100 casings | 30 particles |
| (2) | 0.7 mg/100 casings | 150 particles |
| (3) | 0.8 mg/100 casings | 180 particles |
| (4) | 1.5 mg/100 casings | 240 particles |
| (5) | 0.9 mg/100 casings | 210 particles |
| (6) | 1.8 mg/100 casings | 310 particles |

According to the aforementioned results, it was discovered that, with regard to the structure of the high pressure vessel and the fixation position of the object to be cleaned in the vessel, the cleaning effect was able to be improved by virtue of the contaminant readhesion preventing effect with the arrangement of liquefied gas inlet port<object to be cleaned<liquefied gas outlet port.

WORKING EXAMPLE 6

In order to examine whether there is dependence on the depth and the configuration of the recess structure, the cleaning effect was examined by changing the configuration and the depth of the recess structure. Carbon dioxide was used as a liquefied gas for the cleaning. Cleaning was carried out by the process (6) "supercritical cleaning after repetitively changing the state between the gaseous state and the liquid state five times with the temperature kept constant and the pressure changed", which was the most effective cleaning method examined in connection with Working Example 1. The components are casings produced by press molding and have configurations of the dimensions of: (1) 5 mm in length×30 mm in width×50 mm in height; (2) 5 mm in length×10 mm in width×5 mm in height; (3) 3 mm in length×5 mm in width×20 mm in height; (4) 10.8 mm in diameter×5 mm in height; and (5) 5 mm in diameter×5 mm in height. With each of the cleaning configurations, one hundred casings were cleaned and analyzed. The residual oil content analysis was carried out by extracting oil content with a solvent (carbon tetrachloride) and thereafter measuring the extracted oil content by FT-IR (Fourier transform infrared spectroscopy). Moreover, the particles were measured by means of a particle analyzer (Wafer Surface Analyzer WM-1700/1500 produced by Topcon) after the cleaning. Table 6 shows the results.

TABLE 6

| Casing Configuration | Amount of Residual Oil Content | Amount of Particles |
|---|---|---|
| (1) | 0.1 mg/100 casings | 36 particles/cm$^2$ |
| (2) | 0.2 mg/100 casings | 30 particles/cm$^2$ |
| (3) | 0.2 mg/100 casings | 35 particles/cm$^2$ |
| (4) | 0.1 mg/100 casings | 32 particles/cm$^2$ |
| (5) | 0.2 mg/100 casings | 35 particles/cm$^2$ |

According to the aforementioned results, a cleaning effect was observed regardless of the casing configuration. Therefore, it was found that the cleaning could be carried out regardless of the casing configuration.

WORKING EXAMPLE 7

The cleaning processes of casings that have undergone press molding and cutting were examined. Carbon dioxide and water were used as a liquefied gas for the cleaning. The casings have a material of SUS304 and a recess structure of dimensions of a diameter $\phi$ of 12 mm and a height of 5 mm. The amount of residue (oil content), the amount of particles, the change of the oxide, and the wettability by contact angle measurement depending on the difference of the cleaning process were examined by using the casings. With regard to the cleaning process, there were examined the four processes of: (1) cleaning by changing the state between the gaseous state and the liquid state five times with the temperature kept constant and the pressure changed using carbon dioxide and thereafter shifting the state to the supercritical state and thereafter cleaning; (2) cleaning at 200° C. and 5 Mpa by expelling carbon dioxide and introducing water after the cleaning of (1); (3) cleaning at 200° C. and 5 Mpa by introducing water into carbon dioxide after the cleaning of (1); (4) cleaning only with water at 200° C. and 5 Mpa. During each of the cleaning processes, one hundred casings were cleaned and analyzed. The residual oil content analysis was carried out by extracting oil content with a solvent (carbon tetrachloride) and thereafter measuring the extracted oil content by FT-IR (Fourier transform infrared spectroscopy). Moreover, the particles were measured by means of a particle analyzer (Wafer Surface Analyzer WM-1700/1500 produced by Topcon) after the cleaning.

Moreover, the change of the oxide was measured by using ESCA (X-ray photoelectron spectroscopy) (as the criteria of evaluation of the oxide, the peak intensity of the oxide after each cleaning process was indicated by a ratio assuming the oxide peak intensity of the initial value (after degreasing process) to be one).

Figure 8:
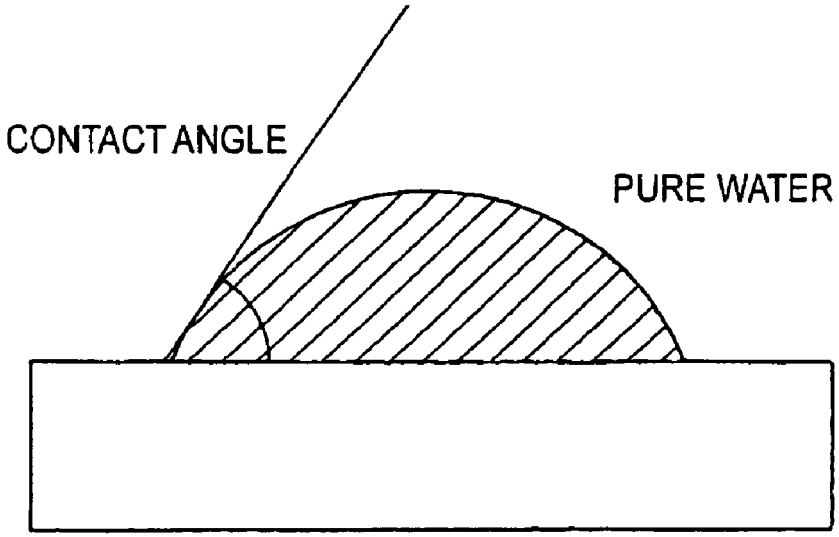
FIG. 8 is an explanatory view for explaining a contact angle in the third working example of the first embodiment of the present invention.

Moreover, the contact angle was measured by using an automatic contact angle meter CA-Z type produced by KYOWA INTERFACE SCIENCE CO., LTD. The contact angle is generally used as an index that represents the conformability (affinity or wettability) to the liquid on the material surface. As shown in FIG. 8, the contact angle means an angle made between the tangent of the droplet and the solid surface at the interface between the three phases of solid, liquid, and gas. The contact angle becomes smaller as the liquid becomes more affinitive to the surface.

Table 7 shows the results. The amount of oxide was standardized by the cleaning process (1) assumed to be one. Moreover the contact angle was measured by pure water as a liquid.

TABLE 7

| Cleaning Process | Amount of Residual Oil Content | Amount of Particles | Amount of Oxide | Contact Angle |
|---|---|---|---|---|
| (1) | 0.2 mg/100 casings | 30 particles/cm$^2$ | 1 | 58° |
| (2) | 0.1 mg/100 casings | 22 particles/cm$^2$ | 0.2 | 19.3° |
| (3) | 0.1 mg/100 casings | 25 particles/cm$^2$ | 0.05 | 24.2° |
| (4) | 0.4 mg/100 casings | 35 particles/cm$^2$ | 0.1 | 31.2° |

According to the aforementioned results, it was found that the oil content and the oxides of the inorganic system could be removed by combining the cleaning process of carbon dioxide with the cleaning by water at 200° C. and 5 Mpa, the contact angle became smaller, and the wettability could be improved.

According to the first embodiment of the present invention, the cleaning effect can be improved by cleaning the object to be cleaned such as the component that has the recess structure by using the cleaning medium of the liquefied gas and the supercritical fluid.

SECOND EMBODIMENT

A pressurized fluid used in the second embodiment of the present invention, and in particular, the meaning of the supercritical state will be described next with reference to FIG. 29.

This second embodiment considers the recycling of the materials removed in the first embodiment. That is, conventionally, during cleaning with the use of a fluid in the supercritical or the subcritical state, various devisal has been made in order to improve the cleaning effect. For example, a method for rapidly changing the state of the fluid in the supercritical or subcritical state is disclosed. However, since the rapid change of state of these fluids gives a physical impact to the object to be cleaned, components are sometimes deformed and chipped off in the extreme case. In particular, components of low densities and components that are thin plates and have complicated recess structures tend to be intensely influenced by them.

On the other hand, with regard to components processed by press molding, and in particular, electronic components, a large amount of lubricating oil is used to improve the accuracy. Therefore, a large amount of hydrocarbon based organic matters, which are the principal ingredients of the lubricating oil, are contained in the cleaning fluid of the component after the processing. Furthermore, organic matters of a surface active agent and so on are contained besides the hydrocarbon based organic matters in the lubricating oil for the purpose of improving the machining accuracy. However, the hydrocarbon based organic matters has not been able to be separated from the organic matters of the surface active agent and so on by normal cleaning, and they were not been able to be recycled.

Moreover, since the cleaning system has been very expensive and much time has been required for the cleaning, the main applications of the objects to be cleaned have been the components of metal molds and so on that have been very expensive and repetitively used.

The second and third embodiments intend to solve these issues.

The cleaning method with a pressurized fluid of the present invention is a method for removing the impurities that adhere to the surface of the object to be cleaned by bringing the pressurized fluid in contact with the object to be cleaned and a cleaning method characterized in that the density of the pressurized fluid is changed without changing the state of the phase of the pressurized fluid brought in contact with the object to be cleaned.

In particular, the density of the object to be cleaned is not greater than the liquid density of the fluid, and a cleaning effect is obtained by repetitively increasing and decreasing the density of the fluid with respect to the density of the object to be cleaned by changing at least one condition of the pressure and the temperature of the fluid. In this case, the effect is increased when the pressurized fluid is a supercritical fluid.

Moreover, the cleaning method with a pressurized fluid of the present invention is a cleaning method for removing the impurities that adhere to the surface of the object to be cleaned by bringing the pressurized fluid in contact with the object to be cleaned, and the cleaning is carried out by bringing a second pressurized fluid of a density different from that of a pressurized first fluid in contact with the object to be cleaned immersed in the pressurized first fluid. In the above case, the cleaning method is characterized in that the second fluid is brought in contact with the object to be cleaned without changing the state of the phase of the first fluid.

In the above case, a preferable effect is obtained when the second fluid is a supercritical fluid. The cleaning effect is improved particularly when the density of the object to be cleaned is not higher than the liquid density of the first fluid and the second fluid of which the density is lower than the density of the object to be cleaned is brought in contact with the object to be cleaned. Moreover, a particularly preferable effect is obtained when the first fluid is identical to the second fluid, the first fluid is liquid and the second fluid is a supercritical fluid.

According to the cleaning method with a pressurized fluid of the present invention, a preferable effect is obtained when the fluid to be used contains at least one of carbon dioxide, water, ammonia, carbon suboxide, and alcohol.

Moreover, the effect is increased when the impurity that adheres to the surface of the object to be cleaned to which the present invention is applied is lubricating oil. Furthermore, the effect is increased when the object to be cleaned to which the present invention is applied is a component that has a recess structure.

Reference is first made to the second embodiment.

Figure 29:
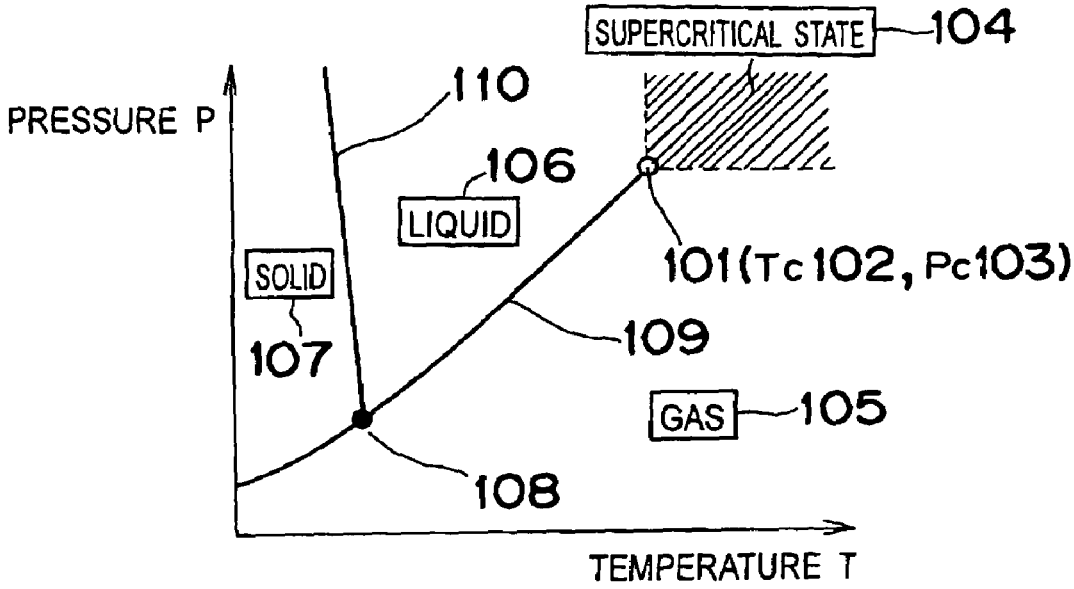

FIG. 29 shows a phase diagram of a fluid of carbon dioxide, water, or the like. In FIG. 29, the abscissa axis represents the temperature, and the ordinate axis represents the pressure. A critical point 101 is located at a point (Tc, Pc) at which the temperature is a critical temperature Tc102 and the pressure is a critical pressure Pc103. A supercritical state 104 is located within a range in which the temperature is not lower than the critical temperature Tc102 and the pressure is not lower than the critical pressure Pc103. In this supercritical state 104, the fluid has a phase different from the gas 105, liquid 106, and solid 107. It is known that this supercritical state is a fluid that exhibits characteristics different from those of gas, liquid, and solid. For example, the density of the fluid in the supercritical state exhibits a value intermediate between gas and liquid and is also able to be adjusted by the conditions of temperature and pressure. Moreover, the supercritical state, which can be controlled with regard to not only the density but also the ionic product, dielectric constant, and diffusion concerning cleaning, can therefore be used as a method for obtaining a high cleaning effect.

Furthermore, the liquid state, of which the density is very high concerning cleaning, is a fluid effective for the cleaning, and therefore, the liquid state is sometimes used according to circumstances. Moreover, besides the supercritical state, a liquid state in which the conditions of pressure and temperature are close to those in the supercritical state in the region of comparatively high temperature and high pressure is sometimes called the subcritical region state, and this pressurized liquid state is sometimes used for the cleaning.

In this case, for example, the critical temperature Tc102 of carbon dioxide as a fluid is about 31.1° C., and the critical pressure Pc103 of carbon dioxide is about 7.38 MPa. In the case of water, the critical temperature Tc102 is about 374.3° C., and the critical pressure Pc103 is about 22.1 MPa.

As the fluid, a material in the gaseous state at normal temperature and pressure is preferable, and carbon dioxide, water, ammonia, carbon suboxide, and so on are used. Otherwise, it is acceptable to use alcohol that dissipates when the temperature is raised a little. Among others, carbon dioxide and water are harmless in human physical terms and therefore easy to handle. Furthermore, carbon dioxide has the effect of resolving and removing the organic matters in the critical state, and water has the effect of etching oxides and so on. Therefore, making the use of their features is effective for cleaning the components that have recess structures.

It is preferable to apply the cleaning method according to the second embodiment of the present invention to components that have recess structures. These components particularly easily attract the lubricating oil of the processing oil and impurities (swarf and so on) to the recess portions. Moreover, since the recess portions have complicated structures and receive pressures applied during the processing, the adhesion of the lubricating oil that is the processing oil is high in comparison with the other flat structure portions, and the cleaning agent and so on are hard to infiltrate. Therefore, nonuniform cleaning and cleaning residues are easily generated. Accordingly, it is highly effective to use a pressurized fluid in the liquid state (including the subcritical fluid) or the supercritical state, the fluid having high permeability as a cleaning medium, and some degree of viscosity and solubility.

Reference is next made to a cleaning method using a pressurized fluid of the second embodiment of the present invention.

The cleaning method of the second embodiment of the present invention is a method for removing the impurities that adhere to the surface of the object to be cleaned by bringing the pressurized fluid in contact with the object to be cleaned and carrying out cleaning by changing the density of the fluid without changing the state of phase of the pressurized fluid brought in contact with the object to be cleaned. Particularly, when the density of the object to be cleaned is not higher than the liquid density of the fluid, the buoyancy applied to the object to be cleaned is changed by controlling the density of the fluid. By the above operation, the object to be cleaned is vertically moved in the fluid in accordance with the repetitive increase and decrease of the density of the fluid with respect to the density of the object to be cleaned, causing a stirring effect. At this time, when the pressurized fluid is a fluid in the supercritical state, the density can be largely changed, and this is preferable. In addition, there is possessed the effect of changing the solubility as a consequence of a change in the dielectric constant in accordance with a change in the density.

For example, in contrast to the fact that the density of carbon dioxide in the gaseous state is about 1 kg/m$^3$ at 0.1 MPa and 30° C., its density in the liquid state can be controlled to about 600 to 1600 kg/M$^3$ at 30° C. to 15° C. and to about 200 kg/M$^3$ to 1000 kg/M$^3$ or more at or above the critical pressure in the supercritical state although the density depends on the conditions of temperature and pressure. Therefore, it is characterized that the object to be cleaned preferably has the above-mentioned density ranges.

The density of the object to be cleaned is preferably within a density range of about 200 kg/M$^3$ to about 1500 kg/m$^3$, and the density of the object to be cleaned preferably is within a density range of about 200 kg/m$^3$ to about 1000 kg/M$^3$ when a fluid in the supercritical state is used. As the object to be cleaned, a component constructed of a resin molded product or a lightweight material that has a resin mold or internally has a hollow structure can be suitably used. As the object to be cleaned, for example, a component in which hollow glass beads are molded with epoxy resin or the like is used as an acoustic matching component of an ultrasonic sensor. In the molding stage, the hollow glass beads are cut or pulled out by the cutting or the like, and then a recess structure of the size of the beads is formed on the processed surface. The size of the recess structure has several micrometers to several hundreds of micrometers in width and depth, and the glass fragments cracked in the processing stage enter the inside of the structure. It is difficult to remove the fragments by mere immersion cleaning. Moreover, the residual oil element in the molding and processing stages might exist on the surface and the inside. The effect of the present invention can be exerted for the cleaning of the dirt. It is to be noted that the applicable thing is not limited to this.

Figure 30:
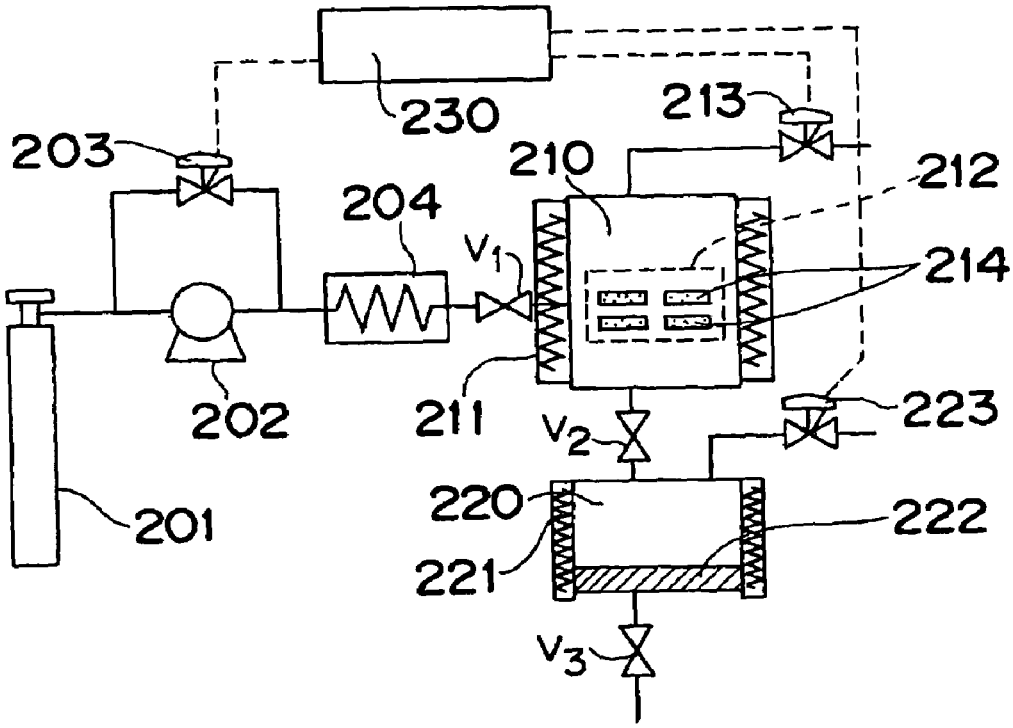
FIG. 30 is a schematic view of a cleaning apparatus according to a second embodiment of the present invention.
Figure 33:
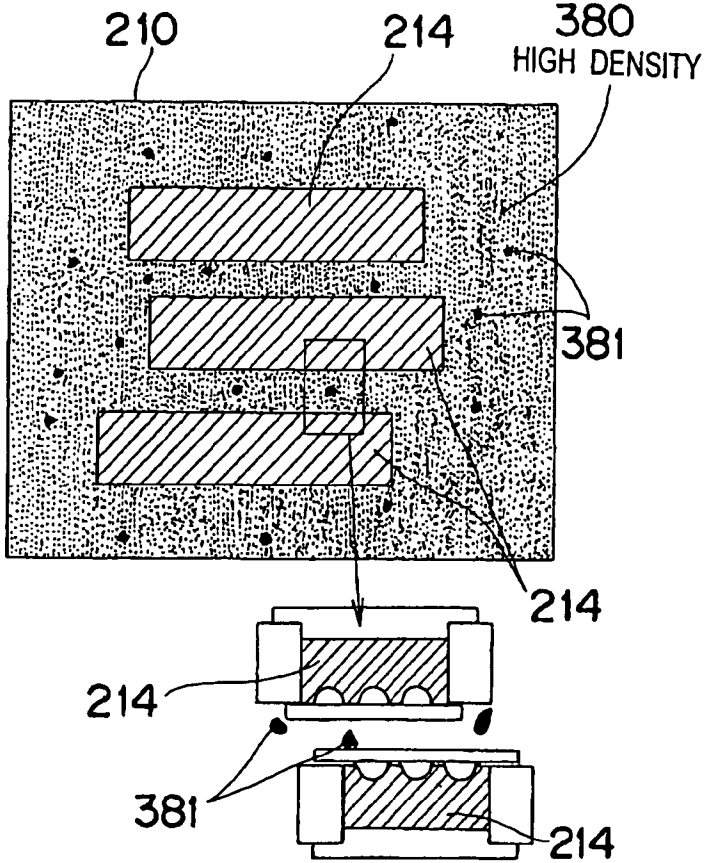
FIG. 33 is a schematic explanatory view showing the relation between an object to be cleaned and a fluid when the density of the object to be cleaned is smaller than the density of the fluid.
Figure 32:
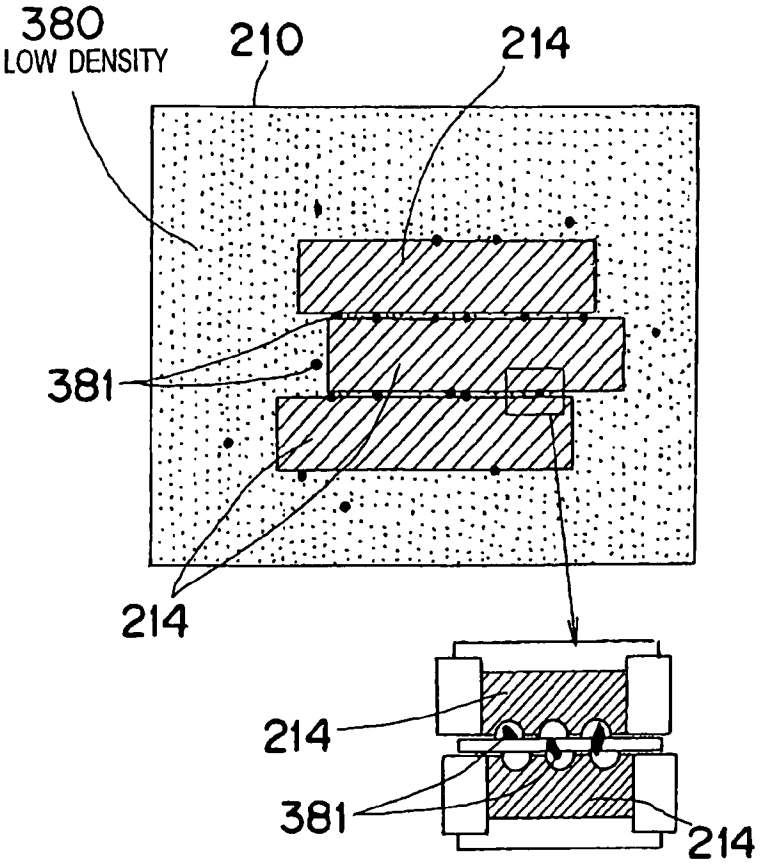
FIG. 32 is a schematic explanatory view showing the relation between an object to be cleaned and a fluid when the density of the object to be cleaned is greater than the density of the fluid.
Figure 35:
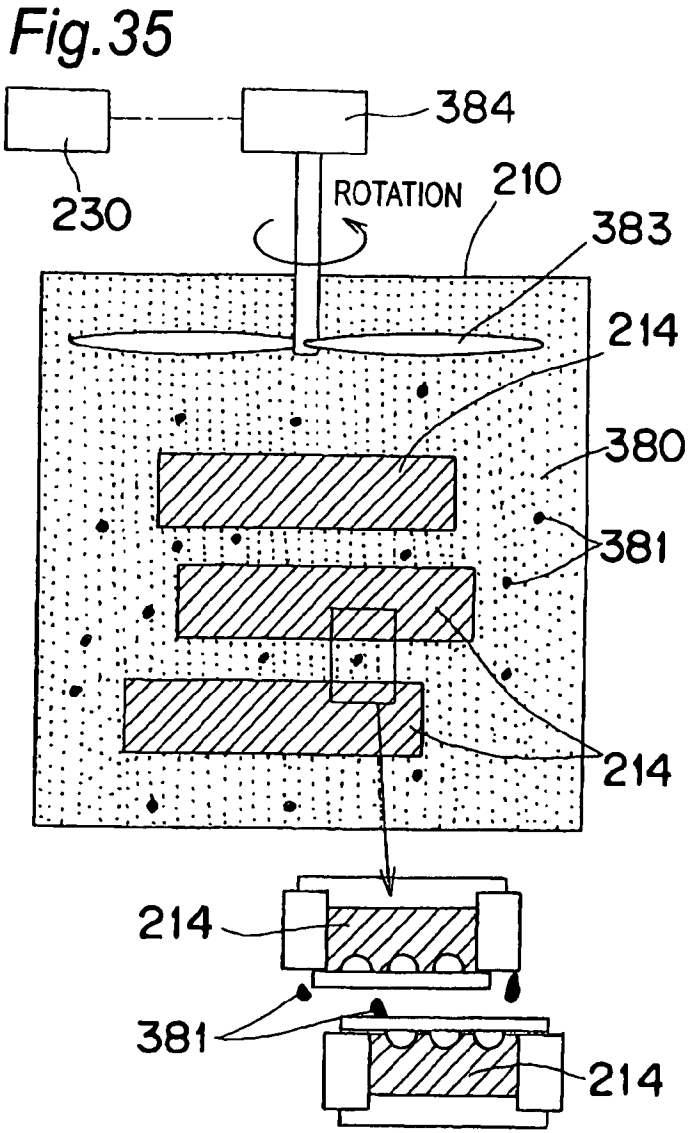
FIG. 35 is a schematic explanatory view showing the relation between an object to be cleaned and a fluid when the density of the object to be cleaned is roughly equal to the density of the fluid and a propeller is rotated.
Figure 34:
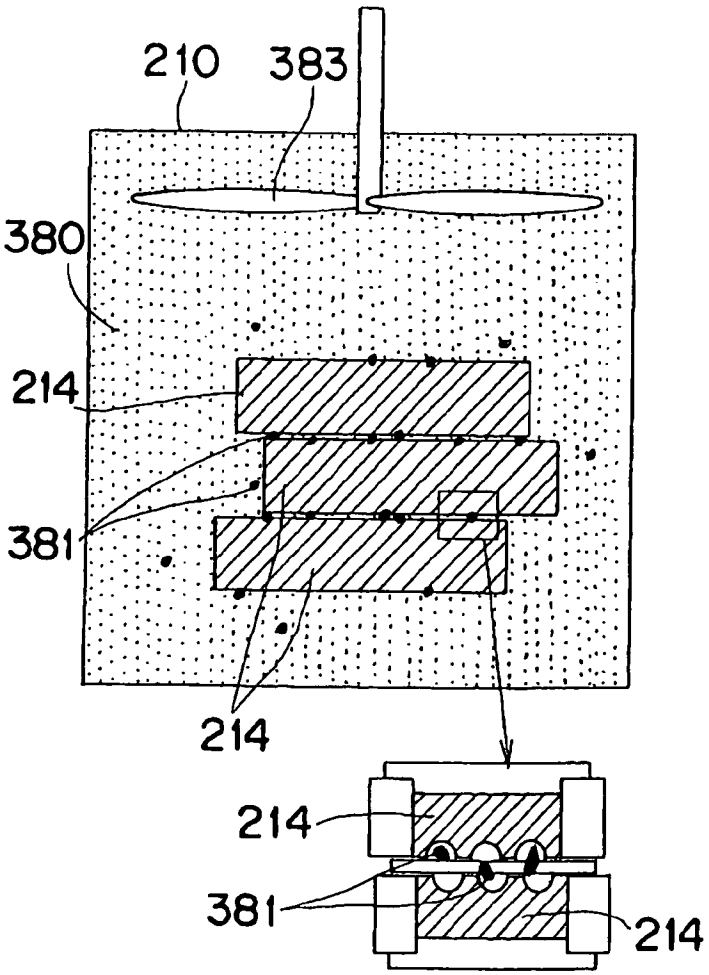
FIG. 34 is a schematic explanatory view showing the relation between an object to be cleaned and a fluid when the density of the object to be cleaned is roughly equal to the density of the fluid and a propeller is not rotated.

FIGS. 30, 32 and 33 are schematic views of a cleaning apparatus for carrying out the cleaning method according to the second embodiment of the present invention. In particular, FIGS. 32 and 33 are views showing the mechanism that it becomes easy to remove the impurities 381 as a consequence of the release of the close adhesion state when an object 214 to be cleaned becomes light depending on the density of the fluid 380 and the cleaning is carried out by a stirring effect by repeating the motion.

This apparatus has the main constituents of a pressure vessel 210 that serves as one example of the cleaning bath, a separation vessel 220 for collecting the impurities 381, a cylinder (or tank) 201 and a liquid pump 202 for supplying a fluid 380, a temperature regulator 204 for the fluid 380, temperature control units 211 and 221 for controlling the temperatures of the respective vessels, and a pressure control unit 230 for controlling pressure control valves 203, 213 and 223.

Reference is made by using carbon dioxide as the fluid 380 and using an epoxy resin cured molded product of hollow glass beads (density: about 550 kg/m$^3$) as the object 214 to be cleaned. The object 214 to be cleaned is put in a cleaning jig 212 and placed in the pressure vessel 210, and the fluid 380 is introduced into the pressure vessel 210 by means of a liquid pump 202 by adjusting the conditions of temperature and pressure by means of the temperature regulator 204 and the pressure control valve 203. The pressure vessel 210 controls the cleaning conditions by means of the temperature control unit 211 for the vessel and the pressure control unit 230. Carbon dioxide is transferred as the fluid 380 in the supercritical state at about 47° C. and about 12 MPa to the pressure vessel 210. The density of carbon dioxide in this condition is about 600 kg/m$^3$, and therefore, the object 214 to be cleaned is floating in the fluid of carbon dioxide with the pressure vessel 210. If the pressure is controlled with the temperature kept constant from this initial state, then the density of the fluid 380 becomes about 500 kg/m$^3$ at about 10 MPa or becomes lighter than the density of the object 214 to be cleaned. Consequently, the object 214 to be cleaned starts to sink. Moreover, if the temperature is controlled with the pressure kept constant from the initial state, then the density of the fluid 380 becomes about 500 kg/M$^3$ at about 55° C. or becomes lighter than the density of the object 214 to be cleaned. Consequently, the object 214 to be cleaned starts to sink. By increasing and decreasing the density of the fluid 380 by controlling the pressure or the temperature or both of them, the object 214 to be cleaned can be moved up and down in the fluid 380 (see FIG. 33), and the cleaning effect can be improved by improving the stirring effect. As a result, it becomes easy to effectively elute and remove the impurities 381, which are the elements of the lubricating oil and so on that easily dissolve in carbon dioxide in the supercritical state, even in the recess portions and narrow portions of the object 214 to be cleaned. Moreover, it becomes easy to push and remove the impurities 381, which are the elements of the chipped powders of glass, resin, or the like that are hard to dissolve in carbon dioxide in the supercritical state, out of the recess portions and narrow portions of the object 214 to be cleaned.

When the density of the object 214 to be cleaned and the density of the fluid 380 are roughly the same, it is acceptable to produce the aforementioned cleaning effect by changing the buoyancy applied to the object 214 to be cleaned similarly to the density change by stirring the fluid 380 by rotating a stirring vane 383 under the motion control of the control units of the pressure control unit 230 and so on. This is an example in which the mutual adhesion of the objects 214 to be cleaned is easily canceled by other mechanical actions by bringing the densities of both of them unlimitedly close to each other instead of controlling the density level. This method obviates the need for repetitively increasing and decreasing the density (pressure, temperature) of the fluid, and therefore, the control of the conditions becomes simple.

Figure 36:
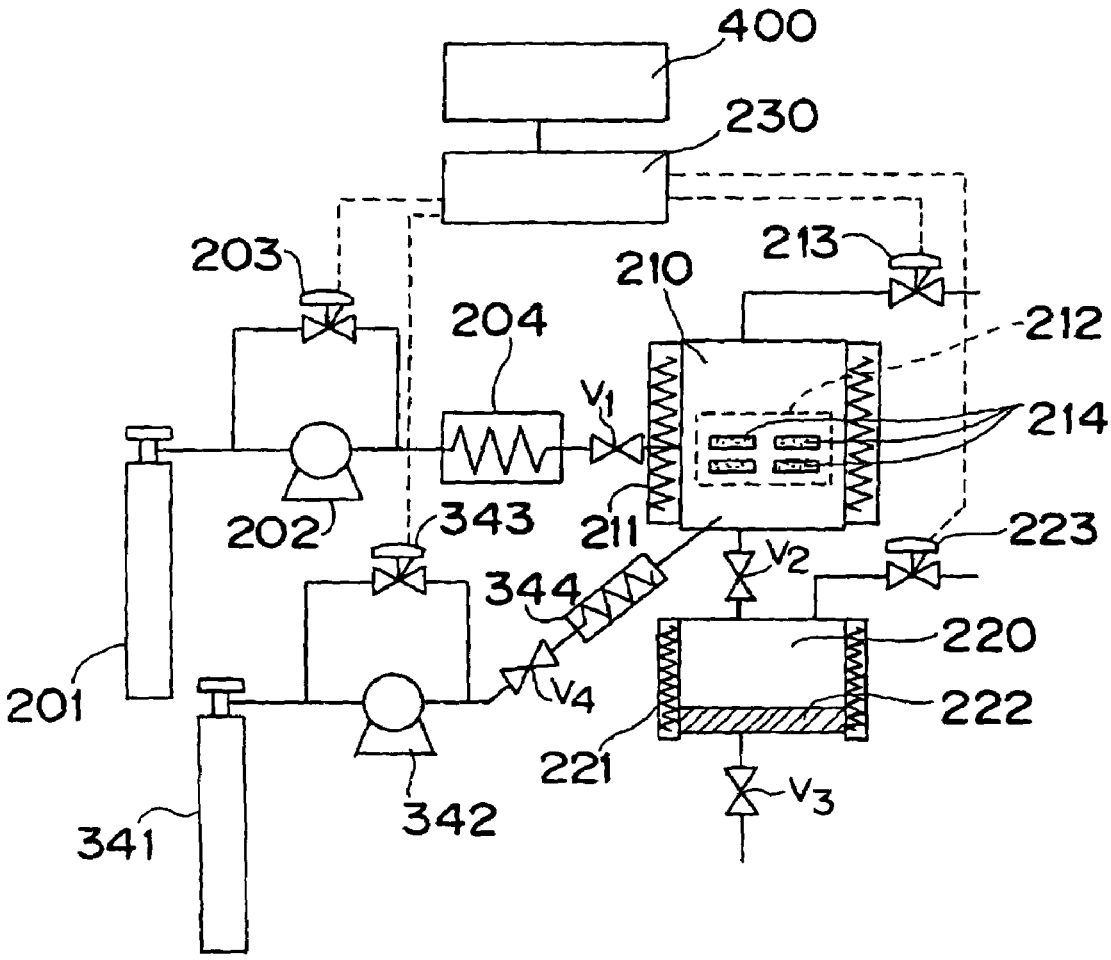
FIG. 36 is a schematic view of the cleaning apparatus of FIG. 30 provided with an information database.

Moreover, mechanical changes due to external forces can be effected by not only mechanical stirring but also nozzle jetting of the fluid. Therefore, FIG. 31 described later shows an application example of a cleaning apparatus according to the third embodiment of the present invention, and FIG. 36 shows an example combined with the nozzle jetting of the fluid. In FIG. 36, the reference numeral 400 denotes a component (object to be cleaned) information database for changing the cleaning conditions for each component. That is, when the density of the object 214 to be cleaned and the density of the fluid 380 are roughly the same on the basis of the information in the information database 400, the mutual adhesion between the objects 214 to be cleaned is easily canceled by the nozzle jetting. This method obviates the need for repetitively increasing and decreasing the density (pressure, temperature) of the fluid, and therefore, the control of the conditions becomes simple.

Moreover, according to this method, by slightly changing the conditions of pressure or temperature with the density of the object 214 to be cleaned and the density of the pressurized fluid 380 made to almost coincide with each other in the initial state, the object 214 to be cleaned can be moved up and down in the pressurized fluid, and therefore, it becomes easy to produce the cleaning effect. Moreover, although FIG. 30 shows the example in which the conditions of the entire pressure vessel 210 are controlled, it is also possible to install a heating mechanism in the neighborhood of the object 214 to be cleaned and raise the temperature in the neighborhood of the object 214 to be cleaned to subside the object 214 to be cleaned by reducing the density only there. It is proper to selectively use these conditions according to the kind and so on of the impurities that adhere to the object 214 to be cleaned. The effect is further improved if a mechanism for assisting the stirring effect outside or inside the pressure vessel 210 is provided in addition to the effect of the present method. As these mechanisms, there can be properly used a rotary vane type stirring mechanism, a stirring mechanism with an ultrasonic vibrator, and so on.

Carbon dioxide in the supercritical state including the impurities removed from the object 214 to be cleaned is transferred to the separation vessel 220 and set back to the gaseous state by reducing the pressure of the carbon dioxide in the supercritical state with the pressure controlled. At this time, the impurities dissolved in carbon dioxide separate in accordance with a reduction in the solubility and therefore are collected as a cleaning residue 222. Moreover, impurities 381 insoluble in carbon dioxide subside and are collected as the cleaning residue 222. By collecting the impurities 381 in a vessel other than the pressure vessel 210, readhesion to the component can be prevented.

Although the fluid is discharged in the gaseous state in FIG. 30, it is also possible to recycle the carbon dioxide in this gaseous state by transferring the same to a fluid pump while cooling carbon dioxide and pressurizing it again. With this arrangement, a continuous cleaning apparatus can be provided.

THIRD EMBODIMENT

Reference is next made to the cleaning method according to the third embodiment of the present invention.

The third embodiment is a method for removing the impurities that adhere to the surface of the object to be cleaned by bringing a pressurized fluid in contact with the object to be cleaned and a method for improving the cleaning effect without changing the state of phase of the pressurized fluid brought in contact with the object to be cleaned. According to the present method, a particularly excellent effect can be obtained by bringing a second fluid in contact with the object to be cleaned without changing the state of phase of a first fluid. By bringing the pressurized second fluid of a density different from the density of the first fluid in contact with the object to be cleaned immersed in the pressurized first fluid, the stirring effect by jetting, bubbles, or the like on the portions to be cleaned is improved.

Furthermore, when the second fluid is a fluid in the supercritical state, the impurities can be effectively removed even in the interior of the component that is hard to clean by virtue of the high diffusivity of the supercritical fluid in the case of the object to be cleaned such as a component that has recess portions and narrow portions. In this case, when the pressurized fluid is a fluid in the supercritical state, the density can be largely changed, and this is favorable. In addition, there is an effect that the solubility changes as a consequence of a change in dielectric constant and so on in accordance with the a change in density.

Moreover, when the first fluid is identical to the second fluid, the first fluid is liquid and the second fluid is a supercritical fluid, a particularly preferable effect can be obtained. The cleaning effect can be improved by taking advantage of the difference in solubility between both fluids when two fluids are different from each other. In contrast to this, when the two fluids are the same, there is an advantage that it is not required to separate the fluids in recycling the fluids after cleaning and efficient cleaning becomes possible. Moreover, when the density of the object to be cleaned is lower than that of the first fluid and higher than that of the second fluid, there can be produced a stirring effect due to the control of the buoyancy by bringing the second fluid in contact with the object to be cleaned and the cleaning efficiency can be improved similarly to the second embodiment.

Figure 31:
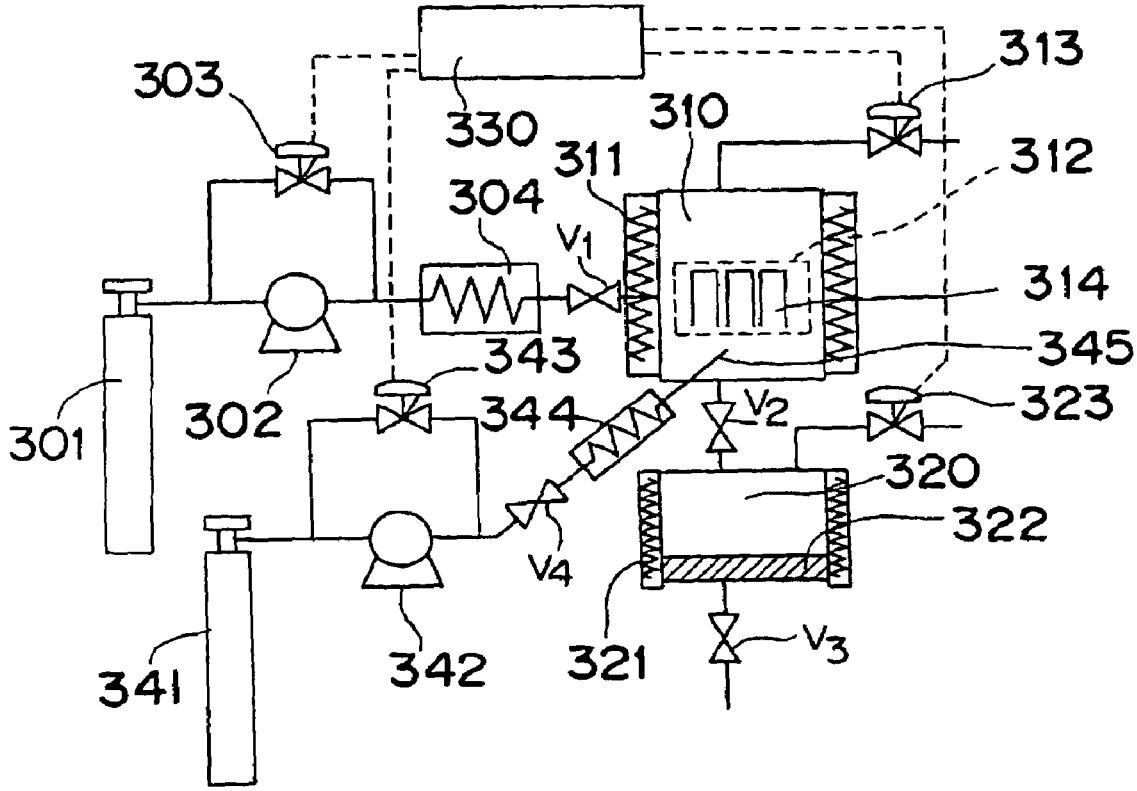
FIG. 31 is a schematic view of a cleaning apparatus according to a third embodiment of the present invention.

FIG. 31 is a schematic view of a cleaning apparatus for carrying out the cleaning method of the third embodiment of the present invention. This apparatus has the main constituents of a pressure vessel 310 as a cleaning bath, a separation vessel 320 for collecting impurities, a cylinder (or tank) 301 and a fluid pump 302 for supplying a first fluid, a temperature regulator 304 for the first fluid, temperature control units 311 and 321 for controlling the temperatures of the respective vessels, and a pressure control unit 330 for controlling pressure control valves 303, 313 and 323. In addition, the second fluid is brought in contact with the neighborhood of an object 341 to be cleaned by means of a cylinder (or tank) 314 and a fluid pump 342 for supplying the second fluid, a temperature regulator 344 for the second fluid, and a pressure control unit 330 for controlling a pressure control valve 343.

Reference is made by using a component that has a recess portion and that is formed by press molding and represented by a hat type SUS (stainless steel) casing or a component formed by the cutting method as the object 314 to be cleaned with carbon dioxide used as a fluid. The object 314 to be cleaned is put in a cleaning jig 312 and placed in the pressure vessel 310, and the fluid of which the conditions of temperature and pressure are controlled by the temperature regulator 304 and the pressure control valve 303 is introduced into the pressure vessel 310 by means of the fluid pump 302. The pressure vessel 310 controls the cleaning conditions by means of the temperature control unit 311 for the vessel and the pressure control unit 330. Carbon dioxide in the liquid state is transferred to the pressure vessel 310, and the object 314 to be cleaned is immersed therein for cleaning. Further, carbon dioxide in the supercritical state, which serves as the second fluid, is brought in contact with the object 314 to be cleaned that has the recess structure in the pressure vessel 310 through a jetting section 345 in the neighborhood of the object 314 to be cleaned by means of the cylinder (or tank) 341 for supplying the second fluid by means of the fluid pump 342, the temperature regulator 344 of the second fluid, and the pressure control unit 330 for controlling the pressure control valve 343.

The object 314 to be cleaned that has the recess structure is arranged in the pressure vessel 310, and the cleaning effect is promoted by the second fluid while being cleaned in the first fluid. When the jetting section 345 of the second fluid is arranged facing the opening of the object 314 to be cleaned, cleaning can be made easy to carry out even to the interior that is hard to clean. It can be considered that a stirring effect by virtue of diffusion or the like due to the contact of fluids of different densities and accompanying impurity peeloff and removal effects, dissolution and removal effects of impurities that have various solubilities with the fluids of different solubilities, and a vibration effect by virtue of an impact for pressure equalization and so on when there is a pressure difference between the fluids are produced to accelerate the cleaning effect. With these effects, it becomes easy to effectively elute and remove the elements of the lubricating oil and so on that easily dissolve in the fluids even to the recess portions and the narrow portions of the object to be cleaned. Moreover, it becomes easy to push and remove the elements of the chipped powders of glass, resin, or the like that are hard to dissolve in the fluid in the supercritical state, out of the recess portions and narrow portions of the object to be cleaned. At this time, the contact timing of the second fluid may be set continuous, intermittent, at a constant rate or a varied rate, according to the object to be cleaned and so on.

Moreover, when the density of the object 314 to be cleaned is lower than the density of the first fluid in the liquid state, the same stirring effect by virtue of the vertical movement of the object to be cleaned as that of the second embodiment can be obtained by bringing the second fluid of the different density in contact with the object to be cleaned, so that the cleaning effect is improved.

Moreover, a fluid of a mixture of the first fluid and the second fluid that contain the impurities removed from the object 314 to be cleaned is transferred to the separation vessel 320, and the mixed fluid is subjected to separation and collection by controlling pressure or temperature, and a cleaning residue 322 is separated and collected. The separated fluids can each be circulated and recycled by being pressurized. Moreover, if the first and second fluids are the same, the cleaning apparatus and the cleaning operation can be simplified.

Components that are expected to have a cleaning effect by the cleaning methods and the cleaning apparatuses of the second and third embodiments of the present invention are mainly electronic components used for electronics and associated components. The components are, in particular, precision-machined components obtained by press molding and cutting. A lubricating oil, which is always the processing oil, is necessary and indispensable for these components in order to improve the machining accuracy. However, the remaining of this processing oil influences the performance characteristics of the processing in the next process such as plating and bonding and causes reductions in the performance and reliability of the device and the product. Therefore, effects are produced for the high-level removal of the residues, i.e., for the components that require precision cleaning. Application commodities to which the present invention is applied are the matching layers of ultrasonic sensors and electrodes of cells (particularly, secondary cells and so on) in addition to other commodities of casings for cells, casings (also called housings) for HDD's, and casings for electrolytic capacitors. The matching layers for ultrasonic sensors and so on are provided by various materials such as a mixture of glass balloons of the inorganic system and epoxy resin of the organic system, the single material of the glass balloons of the inorganic system, and the single material of epoxy resin of the organic system. Moreover, the casings for the ultrasonic sensors and so on are made of a material of stainless steel, aluminum, or epoxy resin. With regard to the processing, they are processed by deep drawing by press molding, resin molding, or cutting. With regard to the casings for cells, there is generally used aluminum or recently used a multi-layer steel material of plated aluminum, and they are produced by press molding. With regard to the casings for HDD's, there is used a material of aluminum or recently particularly used a complex steel material obtained by coating aluminum with a coating of the organic system, and they are processed by press molding. The casings for electrolytic capacitors are similarly obtained by press molding a single material of aluminum or a complex steel sheet obtained by coating an aluminum material with an organic coating film. As described above, the present invention is applicable by selecting the processes and the gas type of the cleaning medium to be used also for a complex material in which different materials of organic matters and inorganic matters are laminated. It is beyond the argument that the present invention is not limited to these products and fields, and the effects are produced also for the components that have recess structures processed by press molding and cutting.

The effects of the second and third embodiments of this invention will be described below on the basis of concrete working examples.

WORKING EXAMPLE 8

A molded product obtained by impregnating hollow glass beads (about 30 μm) with epoxy resin and curing the same by heating was processed by cutting into a prescribed component configuration and thereafter cleaned. The component configuration had the dimensions of a diameter ϕ of 10.8 mm by a height of 1.15 mm and a density of about 550 kg/M$^3$. This component had a number of recess structures of the size of the beads because the hollow glass beads are cut or fall off in the processed plane.

The effect of cleaning was evaluated by visual inspection and measuring the amount of insoluble particles adhering to the surface. The visual inspection was carried out by visually confirming the presence or absence of chipping, cracking and so on, and the particles were observed after cleaning about the existence of impurities on the component surface and inside the recess portions by means of a stereoscopic optical microscope and a scanning electron microscope.

Cleaning was carried out by putting every batch of 100 components in a basket-shaped cleaning jig and using carbon dioxide as the fluid. There were comparisons among the following cleaning methods:

(1) no cleaning; (2) immersion in carbon dioxide in the supercritical state (about 57° C., 13 MPa, density of about 550 kg/M$^3$) and subsequent cleaning for three hours by repetitively increasing and decreasing the pressure between 12 MPa and 14 MPa at intervals of 10 minutes; (3) immersion and cleaning in carbon dioxide in the supercritical state (about 47° C., 12 MPa, density of about 600 kg/M$^3$) for three hours; (4) immersion in carbon dioxide in the liquid state (about 20° C., density of about 750 kg/M$^3$) for one hour and subsequent cleaning on the condition of (2); (5) immersion in carbon dioxide in the supercritical state (about 47° C., 12 MPa, density of about 600 kg/M$^3$) for one hour and subsequent cleaning carried out by repeating three times bringing the inside of the vessel into the gaseous state with the temperature kept constant and the pressure rapidly released. The results are shown in Table 8.

TABLE 8

| Cleaning Method | External Appearance | Particles |
|---|---|---|
| (1) | ○ | x Visually Observed |
| (2) | ○ | ○ |
| (3) | ○ | x Visually Observed (Partially) |
| (4) | ○ | x Observed by SEM |
| (5) | x | ○ |

In the case of this component, it was found that the cleaning effect of impurities particularly insoluble in carbon dioxide was low when the components were merely immersed in the pressurized carbon dioxide as in the cases of (3) and (4). This is because the components float in the fluid and overlap one another and the overlapped portions do not separate to undergo no cleaning. Moreover, it was found to be difficult to remove the impurities in the interiors of the minute recess portions of the components when the components were merely brought in contact with the fluid. Moreover, generating an abrupt phase change of the fluid as in the case of (5) promotes the removal of the impurities by the impact, whereas some components of low density exhibited chipping and cracking due to the mutually collision of the components.

In contrast to the above, it was found that the cleaning took a satisfactory effect on the recess portions by the cleaning method (2) of the present invention. It was found that this effect was caused by the separation of the contact surfaces of the components due to the vertical movement of the components as a consequence of the change in the density of pressurized carbon dioxide and the accompanying stirring effect as the result of observing the inside of the pressure vessel.

WORKING EXAMPLE 9

A casing processed by press molding and cutting was cleaned. The casing is made of a material of SUS304 and has a recess structure of the dimensions of a diameter ϕ of 12 mm and a height of 5 mm.

By carrying out cleaning every batch of 100 casings and analyzing the same, the effect of the cleaning was evaluated by visual inspection, residual oil content inspection and measuring the amount of insoluble particles adhering to the surfaces. The visual inspection was carried out by visually confirming the presence or absence of chipping, cracking and so on. The residual oil content analysis was carried out by extracting the oil content with a solvent (carbon tetrachloride) and thereafter measuring the extracted oil content by FT-IR (Fourier transform infrared spectroscopy). Moreover, the particles were measured by means of a particle analyzer (Wafer Surface Analyzer WM-1700/1500 produced by Topcon) after the cleaning.

Cleaning was carried out by putting every batch of 100 casings in a basket-shaped cleaning jig and using carbon dioxide when only one fluid was used. Moreover, when two fluids were used, the cleaning was carried out by using carbon dioxide in the liquid state as the first fluid and using carbon dioxide in the supercritical state as the second fluid. There were comparisons among the following cleaning methods:

(1) cleaning for three hours while jetting carbon dioxide in the supercritical state (about 47° C., 12 MPa) against the components immersed in carbon dioxide in the liquid state (about 20° C.); (2) cleaning for three hours by immersion in carbon dioxide in the supercritical state (about 47° C., 12 MPa); (3) immersion in carbon dioxide in the liquid state (about 20° C.) for one hour and subsequent cleaning on the condition of (2); (4) immersion in carbon dioxide in the supercritical state (about 47° C., 12 MPa) for one hour and subsequent cleaning carried out by repeating three times bringing the inside of the vessel into the gaseous state with the temperature kept constant and the pressure rapidly released. The results are shown in Table 9.

TABLE 9

| Cleaning Method | External Appearance | Amount of Residual Oil Content (mg/100 components) | Amount of Particles (particles/cm$^2$) |
|---|---|---|---|
| (1) | ○ | 0.1 | 35 |
| (2) | ○ | 0.3 | 100 |
| (3) | ○ | 0.2 | 100 |
| (4) | x (Scratches) | 0.2 | 30 |

With regard to the external appearance, there was observed no discoloration due to the adhesion of oil content by any of the methods, and the amount of the residual oil content was able to be reduced by using the pressurized carbon dioxide. However, it was found that the effect was small by the cleaning only through immersion with regard to the particles insoluble in carbon dioxide. Particularly, it was observed that the particles existed in the recess structure. In contrast to the above, it was found that the cleaning took satisfactory effect on the removal of impurities by the cleaning method (1) of the present invention.

According to the present invention, by bringing the pressurized fluid in contact with the object to be cleaned such as the component that has the recess structure by controlling the density of the fluid, the impurities of the lubricating oil and so on dissolved in the fluid can be efficiently removed by the solvent effect of the pressurized fluid. Furthermore, with the stirring effect by controlling the density of the fluid brought in contact with the component, the impurities insoluble in the fluid can be efficiently removed. Therefore, by optimizing the cleaning conditions suitable for the component in the cleaning process of the present invention, the stirring effect can be concurrently produced in addition to the solvent effect of the pressurized fluid, and efficient component cleaning can be achieved. This is industrially very valuable.

Moreover, by releasing the close adhesion between the object to be processed and the object to be processed in order to modify the surface by applying the aforementioned technique for releasing the close adhesion, it is possible to apply the technique to the uniforming of the surface quality of the object to be processed, hydrophilization by the formation of a hydroxyl group or the like, water or oil repellency by a surface preparation agent or the like, coating of another material on the surface, and so on. For the surface modification, it is also possible to obtain an effect that the surface modification can be efficiently achieved by adding a processing agent to this fluid in the case of jetting the second fluid. Moreover, by releasing the close adhesion between the object to be processed and the object to be processed for extraction, it becomes possible to efficiently extract the element from inside the object to be processed and apply this also to the extraction of oils and fats of the lubricating oil and so on, the extraction of essence and perfume from plants, and so on.

The surface modification takes advantage of the fact that the characteristic of $CO_2$ of the fluid becomes affinitive with the oils and fats of the lubricating oil (solubility is increased) by pressurizing the casing of the object to be processed, the lubricating oil of the impurity, and $CO_2$.

According to the above-mentioned extraction, the object to be extracted is dissolved in the solvent by taking advantage of the fact that the solubility of the object to be extracted into $CO_2$ is changed (in other words, the density of $CO_2$ of the solvent is changed) by changing the temperature and the pressure of $CO_2$ so as to microscopically release the close adhesion of the molecules and macroscopically dissolve them, and thereafter, the object to be extracted is extracted through deposition by dissolving the object to be extracted in the solvent and thereafter reducing temperature and pressure.

By properly combining the arbitrary embodiments of the aforementioned various embodiments, the effects possessed by the embodiments can be produced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A cleaning method for removing adhering substances that adhere to at least a surface of a recess structure of a component that has the recess structure, the method comprising:

accommodating the component to which the adhering substances adhere, in a cleaning bath;

sequentially introducing a cleaning medium into the cleaning bath from a plurality of nozzles arranged radially on a cylindrical side surface of the cleaning bath so as to generate convection in the cleaning bath, the cleaning medium including carbon dioxide and water;

changing a state of the cleaning medium alternately between a liquid state and a gaseous state by changing at least one of a temperature and a pressure of the cleaning medium so as to cause convection of a liquefied gas of the cleaning medium; and after said changing of the state of the cleaning medium alternately between the liquid state and the gaseous state, changing the cleaning medium in the gaseous state into a supercritical state to carry out the cleaning of the surface of the recess structure, wherein the component having the recess structure is a structure formed by a press molding or cutting method, wherein the adhering substances comprise organic matter including lubricating oil, and particle matter including swarf which has been pressed into the surface of the recess structure, and wherein the cleaning is carried out by utilizing a physical energy caused by a change in a surface tension of the cleaning medium accompanying a change in density and a change in viscosity of the cleaning medium, or a physical energy accompanying a change of state of the cleaning medium alternately between the liquid state and the gaseous state by the changing of the at least one of the temperature and the pressure.

2. The cleaning method as claimed in claim 1, further comprising:

discharging the liquefied gas from the cleaning bath after changing a state of the cleaning medium alternately between a liquid state and a gaseous state;

introducing new liquefied gas into the cleaning bath; and thereafter changing at least one of the temperature and the pressure of the cleaning medium so as to exceed a critical point temperature or a critical point pressure so as to shift the cleaning medium to the supercritical state.

3. A cleaning method for removing adhering substances that adhere to at least a surface of a recess structure of a component that has the recess structure, the method comprising:

placing the component, to which the adhering substances adhere, in a cleaning bath;

sequentially introducing a cleaning medium into the cleaning bath from a plurality of nozzles arranged radially on a cylindrical side surface of the cleaning bath so as to generate convection in the cleaning bath, the cleaning medium including carbon dioxide and water;

changing a state of the cleaning medium alternately between a liquid state and a gaseous state by changing at least one of a temperature and a pressure of the cleaning medium so as to cause convection of a liquefied gas of the cleaning medium; and after said changing of the state of the cleaning medium alternately between the liquid state and the gaseous state, changing the cleaning medium in the gaseous state into a subcritical state to carry out the cleaning of the surface of the recess structure, wherein the component having the recess structure is a structure formed by a press molding or cutting method, wherein the adhering substances comprise organic matter including lubricating oil, and particle matter including swarf which has been pressed into the surface of the recess structure, and wherein the cleaning is carried out by utilizing a physical energy caused by a change in a surface tension of the cleaning medium accompanying a change in density and a change in viscosity of the cleaning medium, or a physical energy accompanying a change of state of the cleaning medium alternately between the liquid state and the gaseous state by the changing of the at least one of the temperature and the pressure.

4. The cleaning method as claimed in claim 3, wherein the state of the cleaning medium is alternately changed between the gaseous state and the liquid state by changing the pressure of the cleaning medium with the temperature of the cleaning medium kept constant.

5. The cleaning method as claimed in claim 3, wherein the state of the cleaning medium is alternately changed between the gaseous state and the liquid state by changing the temperature of the cleaning medium with the pressure of the cleaning medium kept constant.

6. The cleaning method as claimed in claim 3, wherein the component that has the recess structure is comprised mainly of a metallic material.

7. The cleaning method as claimed in claim 6, wherein the metallic material, which forms the component that has the recess structure, has a principal ingredient of Fe, Al, Cu, or Ti.

8. The cleaning method as claimed in claim 3, wherein the component that has the recess structure is comprised mainly of an organic material.

9. The cleaning method as claimed in claim 8, wherein the organic material, which forms the component that has the recess structure, has a principal ingredient of polyimide or epoxy resin.

10. The cleaning method as claimed in claim 3, wherein the component that has the recess structure is comprised mainly of a ceramic material.

11. The cleaning method as claimed in claim 10, wherein the ceramic material, which forms the component that has the recess structure, has a principal ingredient of $SiO_2$, PZT, Ag, or C.

12. The cleaning method as claimed in claim 3, wherein the component that has the recess structure is comprised: mainly of a complex of a metal and an organic material; mainly of a complex of an organic material and a ceramic material; or mainly of a complex of a metal, an organic material, and a ceramic material.

13. The cleaning method as claimed in claim 3, wherein the component that has the recess structure is a matching layer of an ultrasonic sensor; or a casing for an electronic component, an ultrasonic sensor, a cell, a hard disk drive, or an electrolytic capacitor.

* * * * *